US011007661B2

(12) United States Patent
Mazarakis et al.

(10) Patent No.: US 11,007,661 B2
(45) Date of Patent: May 18, 2021

(54) RECONFIGURABLE SHAVING RAZORS

(71) Applicant: BIC VIOLEX SA, Anixi (GR)

(72) Inventors: Panagiotis Mazarakis, Athens (GR); Vasiliki Lykogeorgou, Athens (GR); Dionysios Athanasiou, Athens (GR); Panagiotis Kopelas, Athens (GR); Maria Petratou, Athens (GR); Argyro Kallivretaki, Athens (GR); Eirini Petratou, Athens (GR)

(73) Assignee: BIC-VIOLEX SA, Anixi (GR)

( * ) Notice: Subject to any disclaimer, the term of this patent is extended or adjusted under 35 U.S.C. 154(b) by 164 days.

(21) Appl. No.: 16/309,160

(22) PCT Filed: Jul. 8, 2016

(86) PCT No.: PCT/IB2016/001092

§ 371 (c)(1),
(2) Date: Dec. 12, 2018

(87) PCT Pub. No.: WO2018/007844

PCT Pub. Date: Jan. 11, 2018

(65) Prior Publication Data

US 2019/0176355 A1 Jun. 13, 2019

(51) Int. Cl.

| | |
|---|---|
| ***B26B 21/22*** | (2006.01) |
| ***B26B 21/52*** | (2006.01) |
| *B26B 21/40* | (2006.01) |

(52) U.S. Cl.

CPC ..... *B26B 21/521* (2013.01); *B26B 21/225* (2013.01); *B26B 21/4037* (2013.01); *B26B 21/522* (2013.01); *B26B 21/523* (2013.01)

(58) Field of Classification Search

CPC . B26B 21/521; B26B 21/4037; B26B 21/522; B26B 21/225; B26B 21/523

USPC ..... 30/537

See application file for complete search history.

(56) References Cited

U.S. PATENT DOCUMENTS

| | | | | |
|---|---|---|---|---|
| 3,363,312 | A * | 1/1968 | Fayed | B26B 21/26 30/40.1 |
| 6,584,696 | B2 * | 7/2003 | Ferraro | B26B 21/22 30/47 |
| 6,880,253 | B1 * | 4/2005 | Gyllerstrom | B26B 21/14 30/50 |
| 8,096,054 | B2 * | 1/2012 | Denkert | B26B 21/225 30/50 |
| 9,259,846 | B1 * | 2/2016 | Robertson | B26B 21/4062 |
| 2004/0107585 | A1 * | 6/2004 | Helmrich | B26B 21/523 30/537 |
| 2006/0080837 | A1 | 4/2006 | Johnson et al. | |
| 2006/0143925 | A1 * | 7/2006 | Johnson | B26B 21/44 30/50 |
| 2006/0242847 | A1 | 11/2006 | Dansreau et al. | |

(Continued)

FOREIGN PATENT DOCUMENTS

| | | | |
|---|---|---|---|
| AU | 2012 216 798 | A1 | 10/2012 |
| CA | 2 928 818 | * | 11/2017 |

(Continued)

*Primary Examiner* — Hwei-Siu C Payer

(74) *Attorney, Agent, or Firm* — Polsinelli PC

(57) ABSTRACT

A shaving razor having a first handle to provide a first use configuration with the first handle operable to be secured to a second handle to provide a second use configuration of the shaving razor.

20 Claims, 10 Drawing Sheets

(56) References Cited

U.S. PATENT DOCUMENTS

| | | | | |
|---|---|---|---|---|
| 2009/0100679 | A1* | 4/2009 | Casciaro | B26B 21/165 30/34.05 |
| 2011/0088269 | A1 | 4/2011 | Walker, Jr. et al. | |
| 2013/0298412 | A1* | 11/2013 | Harski | B26B 21/523 30/526 |
| 2014/0230255 | A1 | 8/2014 | Stevens et al. | |
| 2017/0001322 | A1* | 1/2017 | Shorey | B26B 21/522 |
| 2018/0200900 | A1* | 7/2018 | Eagleton | B26B 21/446 |
| 2019/0176355 | A1* | 6/2019 | Mazarakis | B26B 21/225 |
| 2019/0255721 | A1* | 8/2019 | Psimadas | B26B 21/521 |
| 2020/0198162 | A1* | 6/2020 | Makabi | B26B 21/521 |

FOREIGN PATENT DOCUMENTS

| | | | |
|---|---|---|---|
| EP | 1 812 211 | B1 | 8/2007 |
| WO | 2006/108115 | A1 | 10/2006 |

* cited by examiner

RECONFIGURABLE SHAVING RAZORS

CROSS REFERENCE TO RELATED APPLICATION

This application is a National Stage Application of International Application No. PCT/IB2016/001092, now published as WO2018/007844, filed on Jul. 8, 2016, the entire contents of which are incorporated herein by reference.

1. FIELD

The following description relates to shaving razors. A shaving razor may include a head with one or more blades and one or more handles for manipulating the head. For example, a shaving razor may include a head with one or more blades secured to a first handle to provide a first configuration of the shaving razor, and the first handle may be operable to be secured to a second handle to provide a second configuration of the shaving razor.

2. DESCRIPTION OF RELATED ART

Conventional shaving razors provide a single configuration irrespective of whether such are in use or in storage, which is disadvantageous if storage space is limited, e.g., in a suitcase or travel bag. Further, the single configuration prevents such conventional shaving razors from accommodating differing user preferences, which is disadvantageous if a user has preferences that are not addressed by the single configuration.

SUMMARY

The present disclosure provides a shaving razor that overcomes the aforementioned disadvantages of conventional shaving razors. The shaving razor of the present disclosure generally includes a first handle to provide a first use configuration of the shaving razor. The first handle is operable to be secured to a second handle to provide a second use configuration of the shaving razor.

The aforementioned may be achieved according to one aspect by providing a shaving razor operable to be used in various configurations. The shaving razor may include an upper end component including a shaver head and defining a first grip, a lower end component defining a second grip, and/or a connector operable to allow the razor to be reconfigured between a first use configuration having the upper end component detachably secured to the lower end component, and/or a second use configuration having the upper end component detached from the lower end component. The upper end component and/or the lower end component may be elongated. The upper end component and/or the lower end component may be aligned by the connector to extend in a parallel direction in the first use configuration relative to each other.

The connector may include a male portion and a female portion. The female portion may define a cavity operable to at least partially receive the male portion within the cavity. The female portion may partially surround the male portion in the first use configuration. The male portion may be included on the upper end component or the lower end component. The female portion may be included on the lower end component or the upper end component. The connector may include a slot, or a first slot, extending at least partially along an interior wall of the connector. The connector may include at least one arm, or a first arm, operable to nest within the slot in the first use configuration. The connector may include another slot, or a second slot, extending at least partially along another interior wall of the connector. The connector may include another arm, or a second arm, operable to nest within the another slot in the first use configuration. The wall and/or the another wall may be resilient and operable to expand away from the other or each other when the razor is between the first configuration and the second configuration. The arm and/or the another arm may be operable to prevent rotational movement of the upper end component relative to the lower end component in the first use configuration. The arm and/or the another arm may include a buttress operable to prevent linear movement of the upper end component relative to the lower end component in the first use configuration. A portion of the connector may be resilient. The connector may be operable to detachably secure the upper end component to the lower end component via a snap-fit engagement.

The aforementioned may be achieved according to another aspect of the present disclosure by providing a reconfigurable shaving razor. The shaving razor may include a first component including a shaver head, a first gripping surface, and/or a first portion of a connector. The shaving razor may further include a second component having a second gripping surface and/or a second portion of the connector. The connector may be operable to allow the first component to assume various configurations relative to the second component. The first component and/or the second component may be elongated. The first component and/or the second component may be aligned by the connector to extend in a parallel direction in a first use configuration relative to each other. The connector may include a male portion and a female portion. The female portion may define a cavity operable to at least partially receive the male portion within the cavity.

The female portion may partially surround the male portion in a first use configuration. The male portion may be included on the first component or the second component. The female portion may be included on the second component or the first component. The connector may include a slot extending at least partially along an interior wall of the connector. The connector may include at least one arm operable to nest within the slot in a first use configuration. The connector may include another slot extending at least partially along another interior wall of the connector. The connector may include another arm operable to nest within the another slot in the first use configuration. The connector may include another slot extending at least partially along another wall of the connector. The connector may include another arm operable to nest within the another slot in the first use configuration. The wall and/or the another wall may be resilient and operable to expand away from each other when the razor is between the first configuration and a second configuration. The arm and/or the another arm may be operable to prevent rotational movement of the first component relative to the second component in the first use configuration. The arm and/or the another arm may include a buttress operable to prevent linear movement of the first component relative to the second component in the first use configuration. At least a portion of the connector may be resilient. The connector may be operable to detachably secure the first component to the second component via a snap-fit engagement. The connector may also be operable to detachably secure the first component to the second component via a screwing engagement.

The foregoing is intended to be illustrative and is not meant in a limiting sense. Many features of the embodiments may be employed with or without reference to other features of any of the embodiments. Additional aspects, advantages, and/or utilities of the present disclosure will be set forth in part in the description that follows and, in part, will be apparent from the description, or may be learned by practice of the present disclosure.

BRIEF DESCRIPTION OF THE DRAWINGS

The foregoing summary, as well as the following detailed description, will be better understood when read in conjunction with the appended drawings. For the purpose of illustration, there is shown in the drawings certain embodiments of the present disclosure. It should be understood, however, that the present disclosures is not limited to the precise embodiments and features shown. The accompanying drawings, which are incorporated in and constitute a part of this specification, illustrate an implementation of apparatuses consistent with the present disclosures and, together with the description, serve to explain advantages and principles consistent with the present disclosure.

DETAILED DESCRIPTION

Figures 1A, 1B:
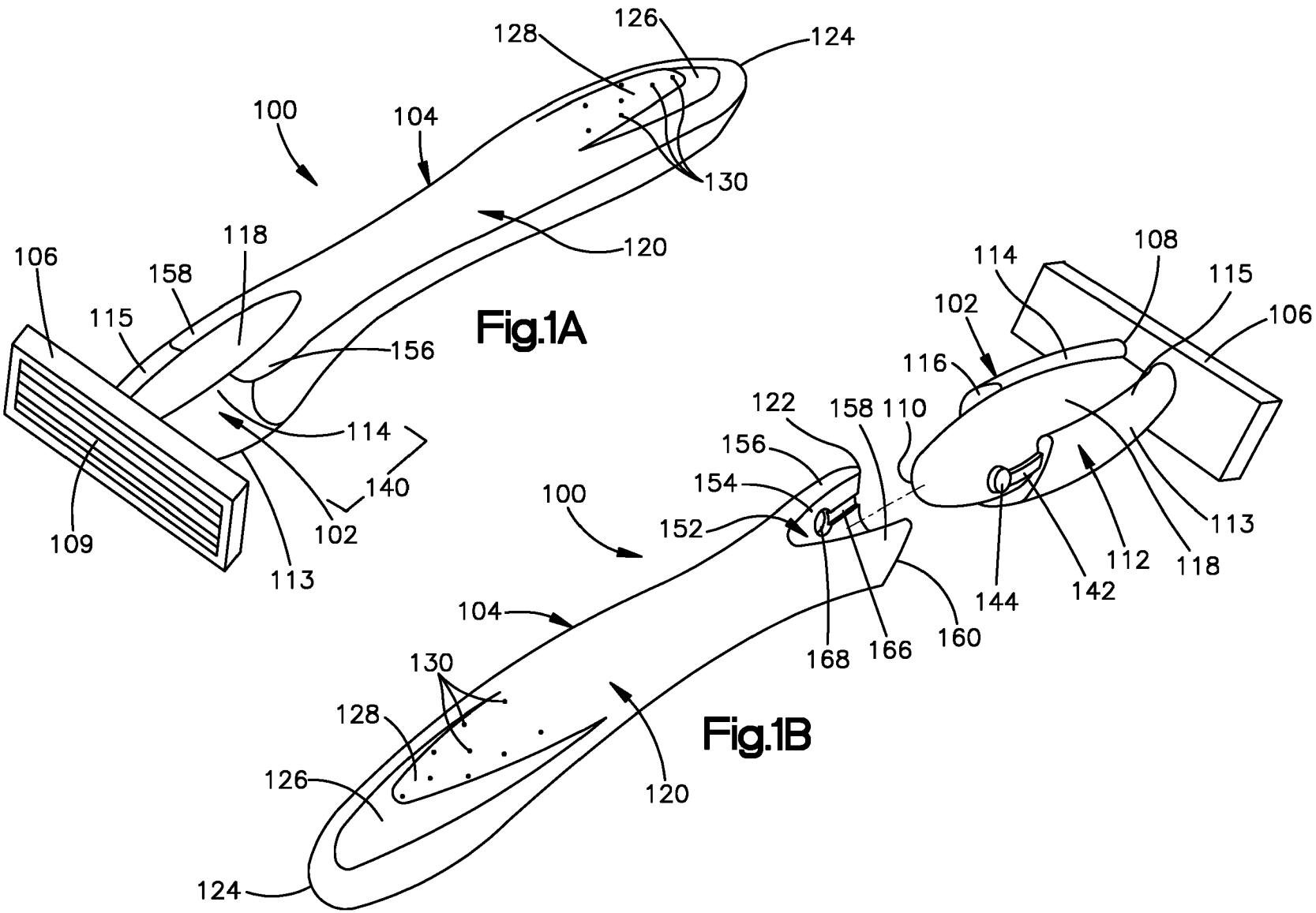
FIG. 1A is a diagram illustrating a perspective view of a shaving razor with a first handle detachably secured to a second handle.
FIG. 1B is a diagram illustrating a perspective view of the shaving razor shown in FIG. 1A with the first handle detached from the second handle.
Figure 1C:
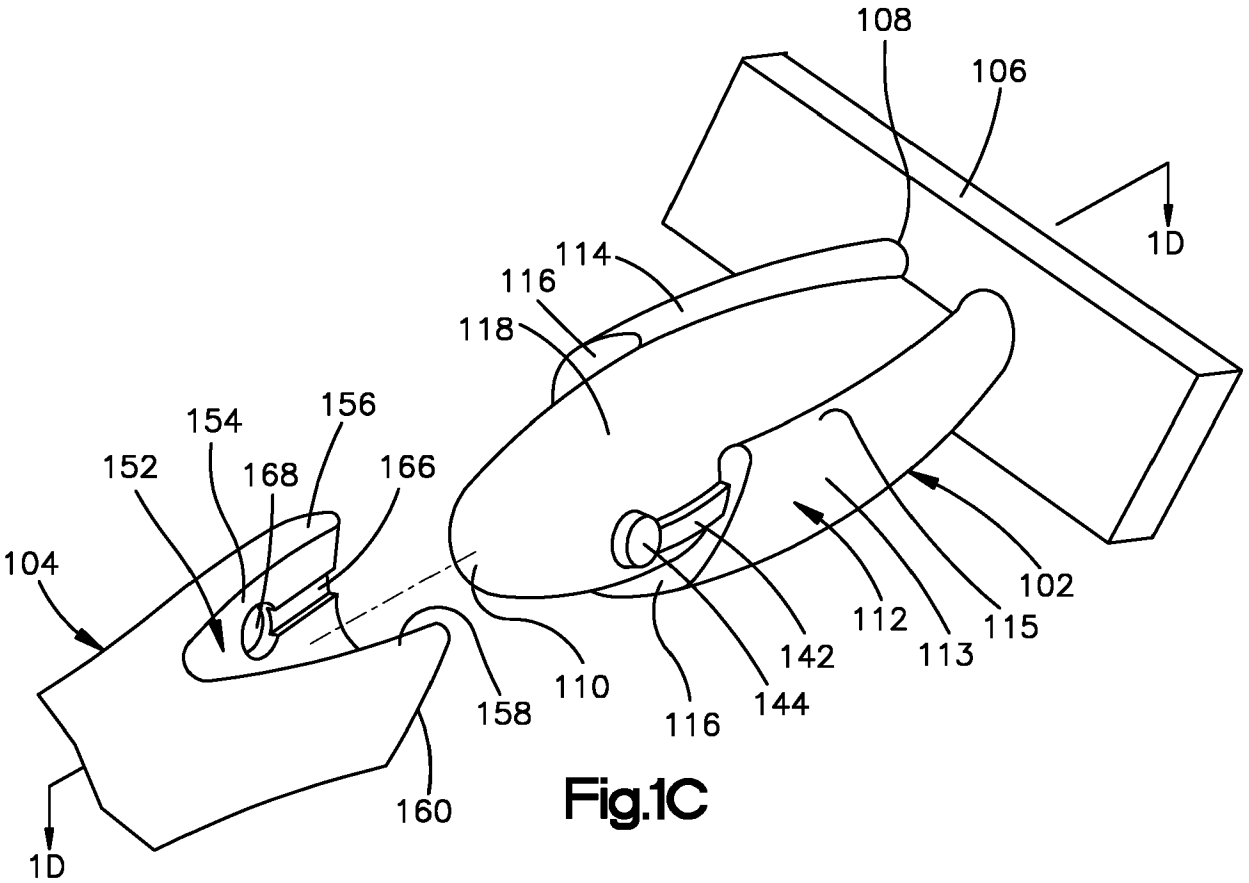
FIG. 1C is a diagram illustrating a magnified perspective view of a portion of the shaving razor shown in FIG. 1B.

It is to be understood that the present disclosure is not limited in its application to the details of construction and to the embodiments of the components set forth in the following description or illustrated in the drawings. The figures and written description are provided to teach any person skilled in the art to make and use the disclosure for which patent protection is sought. The present disclosure is capable of other embodiments and of being practiced and carried out in various ways. Persons of skill in the art will appreciate that the development of an actual commercial embodiment incorporating aspects of the present disclosure will require numerous implementations—specific decisions to achieve the developer's ultimate goal for the commercial embodiment. While these efforts may be complex and time-consuming, these efforts, nevertheless, would be a routine undertaking for those of skill in the art of having the benefit of this disclosure.

I. Terminology

The phraseology and terminology employed herein are for the purpose of description and should not be regarded as limiting. For example, the use of a singular term, such as, "a" is not intended as limiting of the number of items. Also, the use of relational terms such as, but not limited to, "top," "bottom," "left," "right," "upper," "lower," "down," "up," and "side," are used in the description for clarity in specific reference to the figures and are not intended to limit the scope of the present disclosure or the appended claims.

Further, it should be understood that any one of the features of the present inventive concept may be used separately or in combination with other features. Other systems, methods, features, and advantages of the present disclosure will be, or become, apparent to one with skill in the art upon examination of the figures and the detailed description. It is intended that all such additional systems, methods, features, and advantages be included within this description, be within the scope of the present disclosure, and be protected by the accompanying claims.

Further, any term of degree such as, but not limited to, "substantially," as used in the description and the appended claims, should be understood to include an exact, or a similar, but not exact configuration. For example, "a substantially planar surface" means having an exact planar surface or a similar, but not exact planar surface. Similarly, the terms "about" or "approximately," as used in the description and the appended claims, should be understood to include the recited values or a value that is three times greater or one third of the recited values. For example, about 3 mm includes all values from 1 mm to 9 mm, and approximately 50 degrees includes all values from 16.6 degrees to 150 degrees.

Further, as the present disclosure is susceptible to embodiments of many different forms, it is intended that the present disclosure be considered as an example of the principles of concepts of the disclosure and not intended to limit the present disclosure to the specific embodiments shown and described. Any one of the features of the present disclosure may be used separately or in combination with any other feature. References to the terms "embodiment," "embodiments," and/or the like in the description mean that the feature and/or features being referred to are included in, at least, one aspect of the description. Separate references to the terms "embodiment," "embodiments," and/or the like in the description do not necessarily refer to the same embodiment and are also not mutually exclusive unless so stated and/or except as will be readily apparent to those skilled in the art from the description. For example, a feature, structure, process, step, action, or the like described in one embodiment may also be included in other embodiments, but is not necessarily included. Thus, the present disclosure may include a variety of combinations and/or integrations of the embodiments described herein. Additionally, all aspects of the present disclosure, as described herein, are not essential for its practice. Likewise, other systems, methods, features, and advantages of the present disclosure will be, or become, apparent to one with skill in the art upon examination of the figures and the description. It is intended that all such additional systems, methods, features, and advantages be included within this description, be within the scope of the present disclosure, and be encompassed by the claims.

Lastly, the terms "or" and "and/or," as used herein, are to be interpreted as inclusive or meaning any one or any combination. Therefore, "A, B or C" or "A, B and/or C" mean any of the following: "A," "B," "C"; "A and B"; "A and C"; "B and C"; "A, B and C." An exception to this definition will occur only when a combination of elements, functions, steps or acts are in some way inherently mutually exclusive.

II. General Architecture

Turning to FIGS. 1A-1E, a shaving razor 100 is illustrated, which generally includes a body with two elongated components, i.e., an upper end component 102 and a lower end component 104, that are detachably secured together to provide a plurality of different use configurations as illustrated by FIGS. 1A, 1B. In the exemplary embodiment, an overall size of the upper end component 102 is smaller than that of the lower end component 104. The upper end component 102 is sized, shaped, and operable to function as a miniature or pocket-size handle to facilitate use of the shaving razor 100 when the upper end component 102 is detached from the lower end component 104. The upper end component 102 is a miniature or pocket-size handle. The dimension of the upper end component, or the pocket-size handle 102 along a longitudinal direction is comprised between 2 cm and 7 cm. The lower end component 104 is sized, shaped, and operable to function as an extension handle to facilitate use of the shaving razor 100 when the upper end component 102 is attached to the lower end component 104. The upper end component 102 includes a shaver head 106 secured to an end 108 that is opposite to the lower end component 104. In the exemplary embodiment, the shaver head 106 is permanently secured to the upper end component 102, with a fixed orientation thereto, but it is foreseen that the shaver head 106 may be detachably secured to the upper end component 102 and/or pivotably secured to the upper end component 102 without deviating from the scope of the present disclosure. The shaver head 106 houses a plurality of blades 109 and preferably includes at least one and up to ten blades. It is foreseen that the shaving head 106 may include a plurality of additional components, e.g., a guard bar and a cap, on either side of the plurality of blades 109, a lubrication strip, and/or a plurality of fins without deviating from the scope of the present disclosure.

Opposite to the end 108 of the upper end component 102 is a dome-shaped end 110 that forms a portion of a first grip 112. The grip 112 is defined by exterior surfaces of a plurality of intersecting features with different contours that collaboratively allow a user of the shaving razor 100 to securely grip and handle, or manipulate the shaving razor 100 when the shaving razor 100 is in another use configuration as illustrated by FIG. 1B. As will be apparent to one of skill in the art, it is foreseen that the upper-end component 102 may be otherwise shaped and yet have the same or similar functionality as discussed herein without deviating from the scope of the present disclosure. The grip 112 includes a raised portion 113 with shoulders 114, 115 on sides thereof. Each of the shoulders 114, 115 extends along the upper end component 102 from the shaver head 106 and the end 108, and to an approximate midpoint of the upper end component 102. The raised portion 113 defines a ledge 116, which extends partially around the midpoint of the upper end component 102 and between the shoulders 114, 115. The ledge 116 also forms part of the grip 112. Between the shoulders 114, 115 is a depressed connecting surface 118 that also forms part of the grip 112 and part of the dome-shaped end 110. The surface 118 extends along an entire length of the upper end component 102 and between the ends 108, 110.

The lower end component 104 includes a second grip 120. Similar to the grip 112 of the upper end component 102, the grip 120 is defined by exterior surfaces of a plurality of intersecting features with different contours that collaboratively allow the user of the shaving razor 100 to securely grip and handle, or manipulate, the shaving razor 100 when the shaving razor 100 is in the use configuration as illustrated by FIG. 1A. The grip 120 extends along an entire length of the lower end component 104 and between ends 122, 124 of the lower end component 104. The grip 120 includes a wall 126 with a raised connecting surface 128 that extends between portions of the wall 126. In the exemplary embodiment, the lower end component 104 includes a plurality of friction-enhancing surface features 130 formed on a portion of the raised connecting surface 128. The friction-enhancing surface features 130 provide a surface texture that improves gripability of the shaving razor 100 via the grip 120. Although the friction-enhancing surface features 130 are only illustrated on the portion of the raised connecting surface 128, it is foreseen that the friction-enhancing surface features 130 may be formed on one or more other portions of the upper and/or lower end components 102, 104 without deviating from the scope of the present disclosure.

A connector 140 is formed on a portion of each of the upper end component 102 and the lower end component 104. On the upper end component 102, the connector 140 includes a plurality of arms 142 that extend from the dome-shaped end 110. Each of the plurality of arms 142 extends from the ledge 116 and along one side of the dome-shaped end 110. At an end of each of the plurality of arms 142 is a circular buttress 144 that extends further away from the dome-shaped end 110 than the plurality of arms 142. As will be apparent to one of skill in the art, it is foreseen that the circular buttress 144 may be otherwise shaped, e.g., polygonal shaped, and yet have the same or similar functionality as discussed herein without deviating from the scope of the present disclosure. On the lower end component 104, the connector 140 includes a receiver 152 at the end 122 of the lower end component 104. The receiver 152 includes a cavity 154 that partially extends into the lower end component 104 and between opposing walls 156, 158 on either side of the cavity 154. The receiver 152 includes a ledge 160, which extends partially around the lower end component 104, between the walls 156, 158, and defines an outermost surface of the end 122 of the lower end component 104. The connector 140 includes a plurality of slots 166 that extend into an interior portion of each of the walls 156, 158 of the receiver 152. Each of the slots 166 extend from the ledge 160, along one of the walls 156, 158, and partially into the receiver 152. At an end of each of the plurality of slots 166 is a circular depression 168 that extends further into the receiver 152 than the plurality of slots 166.

Each of the plurality of slots 166 are sized and shaped to fully receive one of the plurality of arms 142 and each of the depressions 168 are sized and shaped to fully receive one of the buttresses 144. Thus, when the shaving razor 100 is in the use configuration as illustrated by FIG. 1A, the plurality of arms 142 are entirely nested within the plurality of slots 166 and the buttresses 144 are entirely nested in the depressions 168 so that an entirety of the interior portion of each of the wall 156, 158 continuously abuts the dome-shaped end 110. Further, when the shaving razor 100 is in the use configuration as illustrated by FIG. 1A, the ledge 116 of the upper end component 102 abuts the entirety of the ledge 160 of the lower end component 104. In this manner, each of the ledges 116, 160 are entirely concealed when the shaving razor 100 is in the use configuration as illustrated by FIG. 1A.

Figure 1D:
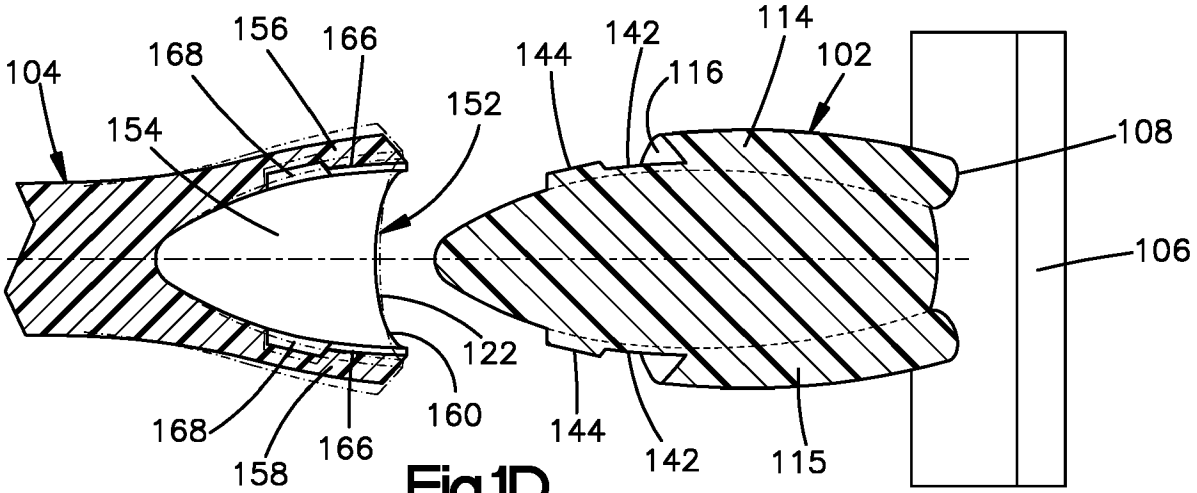
FIG. 1D is a diagram illustrating a magnified cross-sectional top plan view of the shaving razor shown in FIG. 1C along line 1D-1D.
Figure 1E:
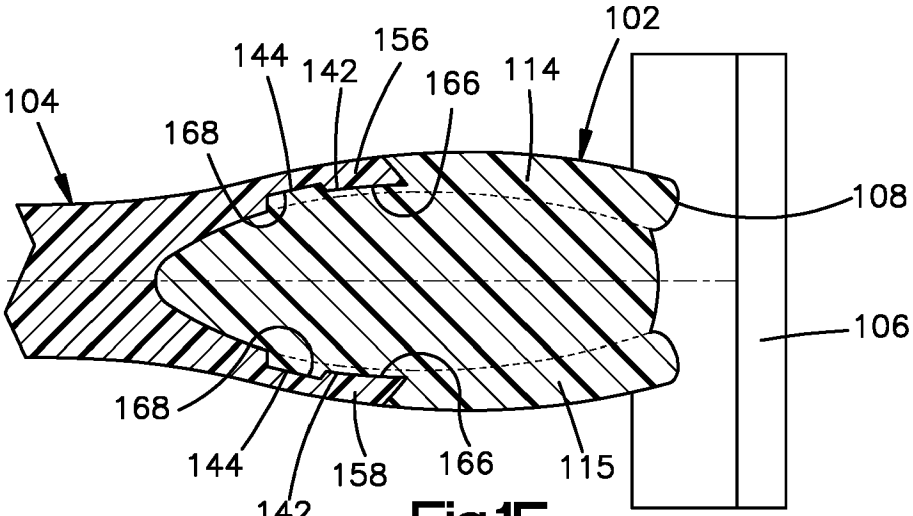
FIG. 1E is a diagram illustrating a magnified cross-sectional top plan view of the shaving razor shown in FIG. 1C along line 1D-1D.

The walls 156, 158 are formed of a resilient material, e.g., rubber, which allows each of the walls 156, 158 to independently bend, e.g., toward or away from each other, upon application of a force by the user and return to an original configuration upon removal of the force, as illustrated by FIG. 1D. The resilient nature of the walls 156, 158 facilitates conversion of the shaving razor 100 to and from the configurations illustrated in FIGS. 1A, 1B. For instance, during attachment of the upper end component 102 to the lower end component 104, the components 102, 104 are aligned in a parallel direction so that the dome-shaped end 110 operates as a male portion and is partially extending between the walls 156, 158 and into the receiver 152, which operates as a female portion. The buttresses 144 abut the ledge 160, which prevents the dome-shaped end 110 from extending further into the receiver 152. Upon application of a force by the user, e.g., a force applied on one of the components 102, 104 to bias the one of the components 102, 104 toward another one of the components 102, 104, one or both of the walls 156, 158 are caused to bend away from the other one of the walls 156, 158, thereby allowing the buttresses 144 to pass, which allows the dome-shaped end 110 to extend further into the receiver 152. The shaving razor 100 is designed such that the dome-shaped end 110 extends into the receiver 152 until: (1) the dome-shaped end 110 abuts an end of the receiver 152; (2) the ledges 116, 160 abut each other; (3) the plurality of arms 142 are entirely nested within the plurality of slots 166; and (4) the buttresses 144 are entirely nested in the depressions 168, all of which generally occur simultaneously, thereby providing a resilient snap-fit engagement between the components 102, 104. Each of the nesting of the plurality of arms 142 within the plurality of slots 166 and the nesting of the buttresses 144 within the depressions 168 independently, and collaboratively, prevent linear and/or rotational movement of the components 102, 104 relative to each other unless a significant force is applied on one or both of the components 102, 104. In the exemplary embodiment, the significant force is twice as great as the force applied to attach the components 102, 104, but it is foreseen that the significant force may be three to ten times as great as the force without deviating from the scope of the present disclosure.

To detach the components 102, 104 from each other, the significant force is applied, e.g., on one of the components 102, 104 to bias the one of the components 102, 104 away from another one of the components 102, 104. The significant force causes one, or both, of the walls 156, 158 to bend away from the other one of the walls 156, 158, thereby allowing the buttresses 144 to be removed from the depressions 168 so that the dome-shaped end 110 can be withdrawn from the receiver 152.

When the shaving razor 100 is in the configuration illustrated in FIG. 1A, the grip 120 can be utilized by the user to guide the shaving head 106 across a surface, e.g., skin, of the user, thereby allowing the plurality of blades 109 to contact and sever hair on the surface of the user. Alternatively, the user may reconfigure the shaving razor 100 to the configuration illustrated in FIG. 1B by removing the lower end component 104 from the upper end component 102, as previously discussed, and utilize the grip 112 to guide the shaving head 106 across the surface of the user, thereby allowing the plurality of blades 109 to contact and sever hair on the surface of the user. The various configurations of the shaving razor 100 can be strategically utilized based on personal preferences of the user. For instance, the user might desire to utilize one or more of the various configurations of the shaving razor 100 to shave different body parts. Or, the user might desire to utilize one or more of the various configurations of the shaving razor 100 based on storage availability for storing the shaving razor 100, e.g., in a suitcase or travel bag.

Figure 2A:
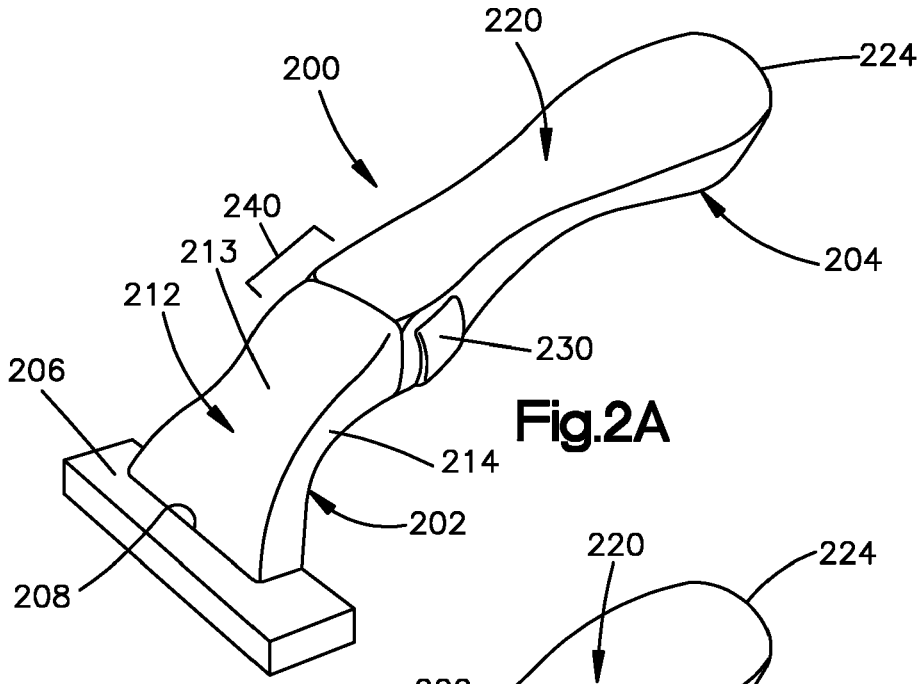
FIG. 2A is a diagram illustrating a perspective view of a shaving razor with a first handle detachably secured to a second handle.
Figure 2B:
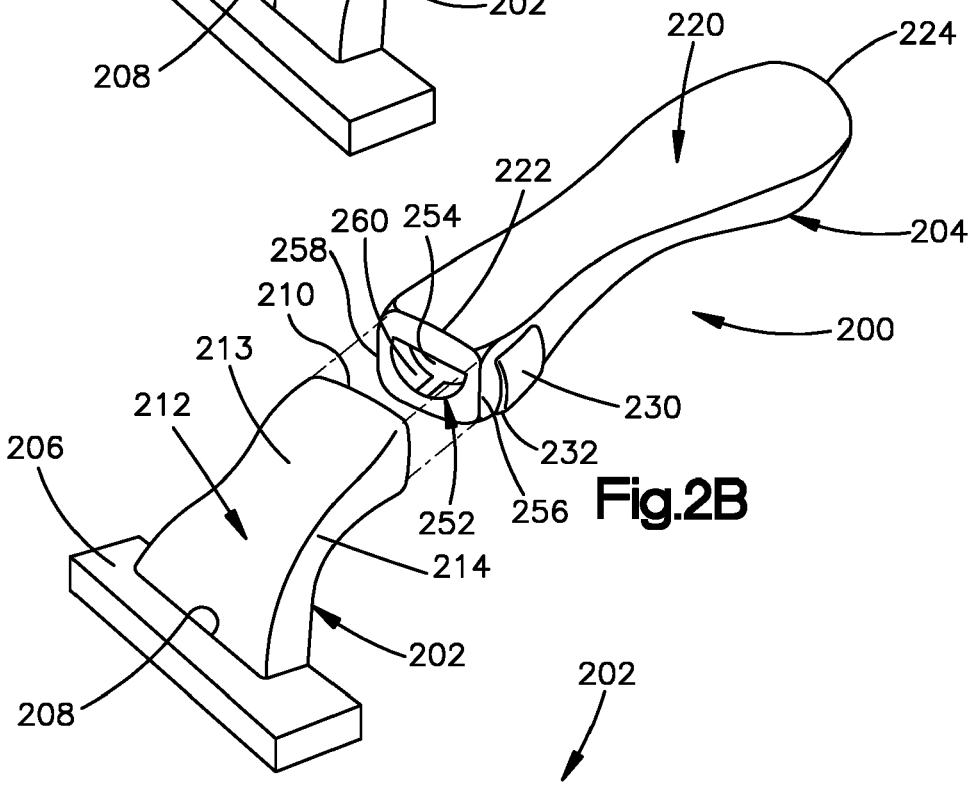
FIG. 2B is a diagram illustrating a perspective view of the shaving razor shown in FIG. 2A with the first handle detached from the second handle.
Figure 2C:
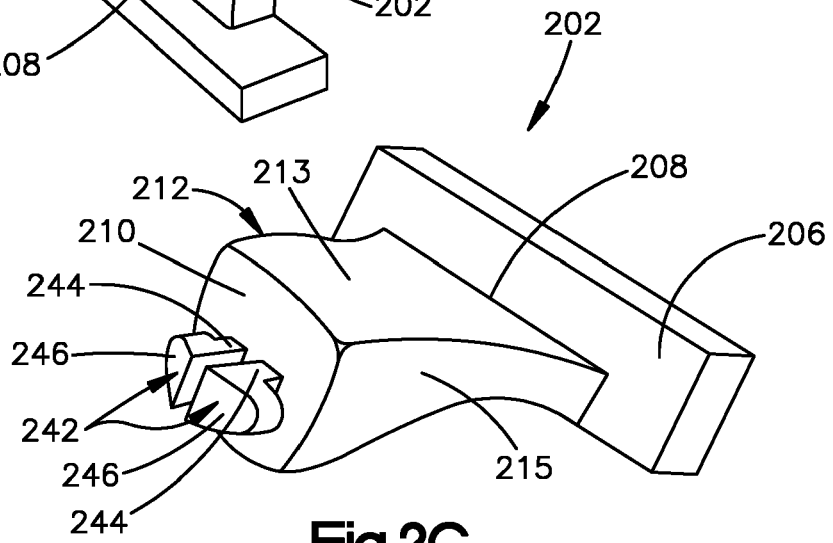
FIG. 2C is a diagram illustrating a magnified perspective view of a portion of the shaving razor shown in FIG. 2A.

Turning to FIGS. 2A-2C, another embodiment of the present disclosure is illustrated with a shaving razor 200. Similar to the shaving razor 100, the shaving razor 200 includes a body with two elongated components, i.e., an upper end component 202 and a lower end component 204, that are detachably secured together to provide a plurality of different use configurations as illustrated by FIGS. 2A, 2C. In this embodiment, an overall size of the upper end component 202 is smaller than that of the lower end component 204. The upper end component 202 is sized, shaped, and operable to function as a miniature or pocket-side handle to facilitate use of the shaving razor 200 when the upper end component 202 is detached from the lower end component 204. The lower end component 204 is sized, shaped, and operable to function as an extension handle to facilitate use of the shaving razor 200 when the upper end component 202 is attached to the lower end component 204. The upper end component 202 includes a shaver head 206 secured to an end 208 that is opposite to the lower end component 204. In this embodiment, the shaver head 206 is permanently secured to the upper end component 202, with a fixed orientation thereto, but it is foreseen that the shaver head 206 may be detachably secured to the upper end component 202 and/or pivotably secured to the upper end component 202 without deviating from the scope of the present disclosure. The shaver head 206 houses a plurality of blades and preferably includes at least one and up to ten blades. It is foreseen that the shaving head 206 may include a plurality of additional components, e.g., a guard bar and a cap, on either side of the plurality of blades, a lubrication strip, and/or a plurality of fins without deviating from the scope of the present disclosure.

Opposite to the end 208 of the upper end component 202 is a generally planar end 210 that forms a portion of a first grip 212. The grip 212 is defined by exterior surfaces of a plurality of intersecting features with different contours that collaboratively allow a user of the shaving razor 200 to securely grip and handle, or manipulate, the shaving razor 200 when the shaving razor 200 is in another use configuration as illustrated by FIG. 2C. The grip 212 includes a plurality of generally planar portions 213, 214, 215 on sides thereof. Each of the portions 213, 214, 215 extends along the upper end component 202 from the shaver head 206 and the end 210 to collaboratively define edges of the end 210.

The lower end component 204 includes a second grip 220. Similar to the grip 212 of the upper end component 202, the grip 220 is defined by exterior surfaces of a plurality of intersecting features with different contours that collaboratively allow the user of the shaving razor 200 to securely grip and handle or manipulate the shaving razor 200 when the shaving razor 200 is in the use configuration as illustrated by FIG. 2A. The grip 220 extends along an entire length of the lower end component 204 and between ends 222, 224 of the lower end component 204.

The lower end component 204 includes buttons 230 within, and partially extending from, apertures 232 in the lower end component 204. Each of the buttons 230 are operable to pivot within the apertures 232 without falling out of the apertures 232 or otherwise detaching from the lower end component 204. In this embodiment, each of the buttons 230 include a ridge on an interior side thereof, which abuts an interior of the aperture, thereby preventing detachment of the buttons 230 from the lower end component 204.

A connector 240 is formed on a portion of each of the upper end component 202 and the lower end component 204. On the upper end component 202, the connector 240 includes a plurality of interlocking protrusions 242 that extend from the end 210. Each of the interlocking protrusions 242 includes a neck 244 that extends from the end 210 and a lip 246 that extends from the neck 244 and angled toward the end 210. In this manner, each of the lips 246 has an angled surface. On the lower end component 204, the connector 240 includes a receiver 252 at the end 222 of the lower end component 204. The receiver 252 includes a cavity 254 that partially extends into the lower end component 204 and between opposing walls 256, 258 on either side of the cavity 254. The receiver 252 includes a ledge 260, which extends entirely around the lower end component 204, between the walls 256, 258, and defines an outermost surface of the end 222 of the lower end component 204.

The receiver 252 is sized and shaped to entirely receive the interlocking protrusions 242 so that the ledge 260 of the lower end component 204 is trapped between each of the lips 246 and the end 210. Thus, when the shaving razor 200 is in the use configuration as illustrated by FIG. 2A, the interlocking protrusions 242 are securely received within the receiver 252. Further, when the shaving razor 200 is in the use configuration as illustrated by FIG. 2A, the end 210 of the upper end component 202 abuts the entirety of the ledge 260 of the lower end component 204. In this manner, the end 210 and the ledge 260 are entirely concealed when the shaving razor 200 is in the use configuration as illustrated by FIG. 1A.

The interlocking protrusions 242 are formed of a resilient material, e.g., rubber, which allows each of the interlocking protrusions 242 to independently bend, e.g., toward or away from each other, upon application of a force by the user and return to an original configuration upon removal of the force. The resilient nature of the interlocking protrusions 242 facilitates conversion of the shaving razor 200 to and from the configurations illustrated in FIGS. 2A, 2B. For instance, during attachment of the upper end component 202 to the lower end component 204, the components 202, 204 are aligned in a parallel direction so that the interlocking protrusions 242 partially extend into the receiver 252 and between the walls 256, 258 until the lips 246 abut the ledge 260, which prevents the interlocking protrusions 242 from extending further into the receiver 252. Upon application of a force by the user, e.g., a force applied on one of the components 202, 204 to bias the one of the components 202, 204 toward another one of the components 202, 204, one or both of the interlocking protrusions 242 are caused to bend toward the other one of interlocking protrusions 242, thereby allowing the interlocking protrusions 242 to pass by the ledge 260, which allows the interlocking protrusions 242 to extend completely into the receiver 252. The shaving razor 200 is designed such that the interlocking protrusions 242 extend into the receiver 252 until: (1) the ends 210, 222 abut each other; (2) the ledge 260 is trapped underneath each of the lips 246 and abuts the necks 244; and (3) the interlocking protrusions 242 abut an interior of the buttons 230 and bias the buttons 230 outwardly, all of which generally occur simultaneously, thereby providing a resilient snap-fit engagement between the components 202, 204. The contours of the receiver 252 and the interlocking protrusions 242 are complementary to prevent rotational movement of the components 202, 204 relative to each regardless of whether a force is applied on one or both of the components 202, 204.

To detach the components 202, 204 from each other, one or both of the outwardly-biased buttons 230 are depressed, which pushes the interlocking protrusions 242 together or toward each other. Upon depression of the buttons 230 and compression of the interlocking protrusions 242, another force is applied, e.g., on one of the components 202, 204, to bias the one of the components 202, 204 away from another one of the components 202, 204. The force allows the interlocking protrusions 242 to be retracted from the receiver 252 and the components 202, 204 to be detached from each other. It is foreseen that the shaving razor 200 could be designed with the receiver 252 and related components on the upper end component 202 and the interlocking protrusions 242 and related components on the lower end component 204 without deviating from the scope of the present disclosure.

Similar to the shaving razor 100, when the shaving razor 200 is in the configuration illustrated in FIG. 2A, the grip 220 can be utilized by the user to guide the shaving head 206 across a surface, e.g., skin, of the user, thereby allowing the plurality of blades to contact and sever hair on the surface of the user. Alternatively, the user may reconfigure the shaving razor 200 to the configuration illustrated in FIG. 2C by removing the lower end component 204 from the upper end component 202, as previously discussed, and utilize the grip 212 to guide the shaving head 206 across the surface of the user, thereby allowing the plurality of blades to contact and sever hair on the surface of the user. The various configurations of the shaving razor 200 can be strategically utilized based on personal preferences of the user. For instance, the user might desire to utilize one or more of the various configurations of the shaving razor 200 to shave different body parts. Or, the user might desire to utilize one or more of the various configurations of the shaving razor 200 based on storage availability for storing the shaving razor 200, e.g., in a suitcase or travel bag.

Figures 3A, 3B:
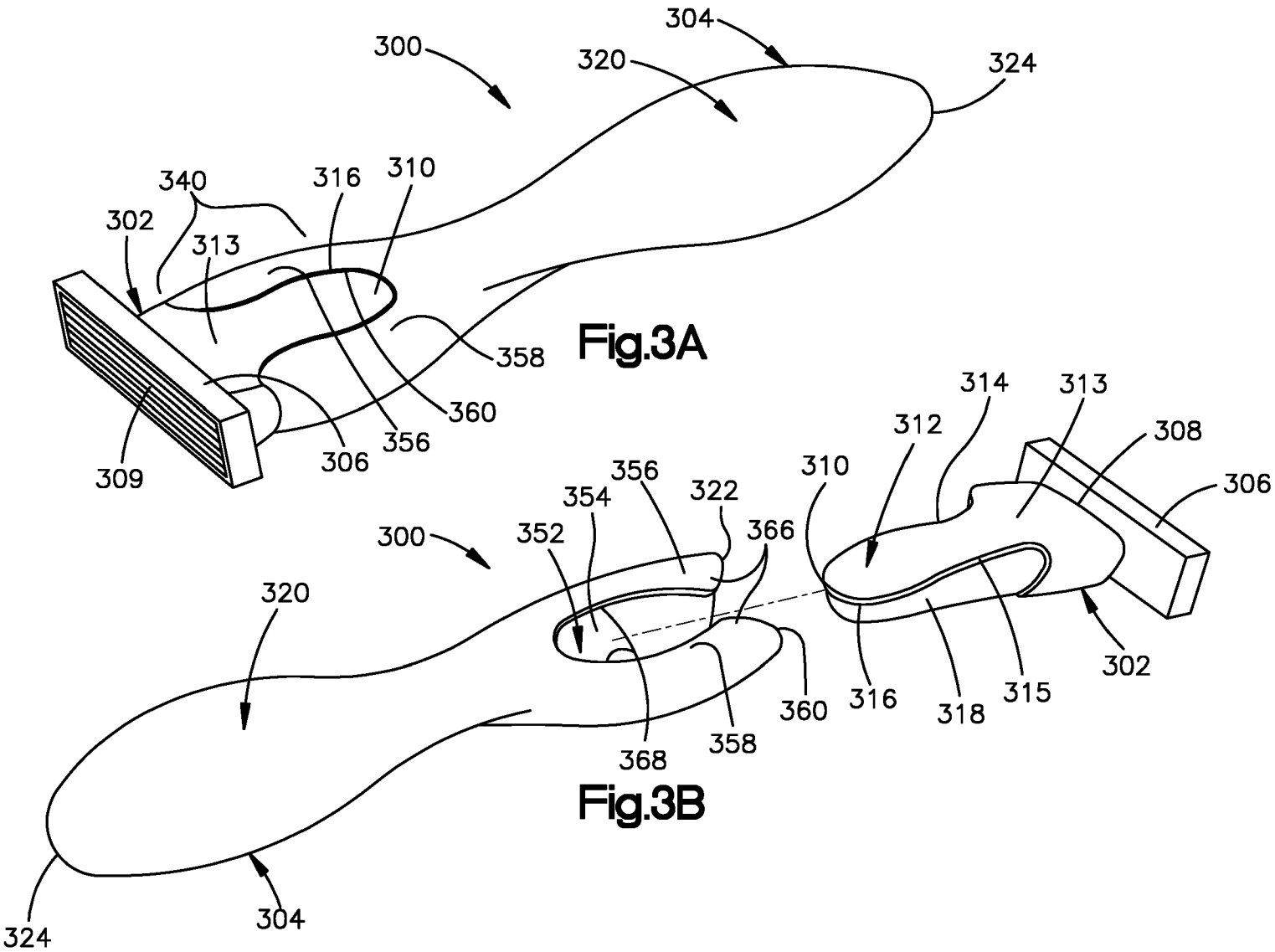
FIG. 3A is a diagram illustrating a perspective view of a shaving razor with a first handle detachably secured to a second handle.
FIG. 3B is a diagram illustrating a perspective view of the shaving razor shown in FIG. 3A with the first handle detached from the second handle.
Figure 3C:
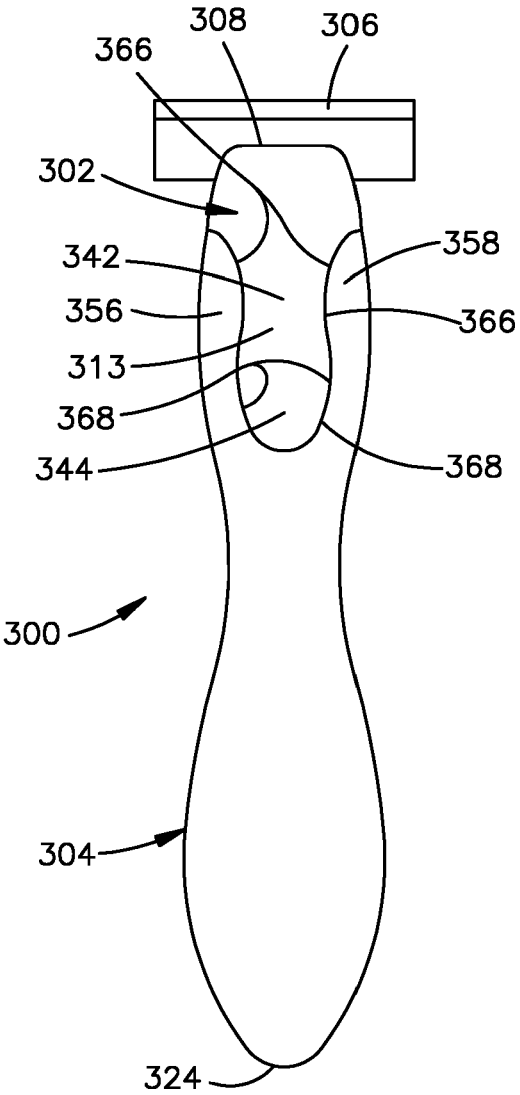
FIG. 3C is a diagram illustrating a top plan view of the shaving razor shown in FIG. 3A with the first handle detachably secured to the second handle.
Figure 3D:
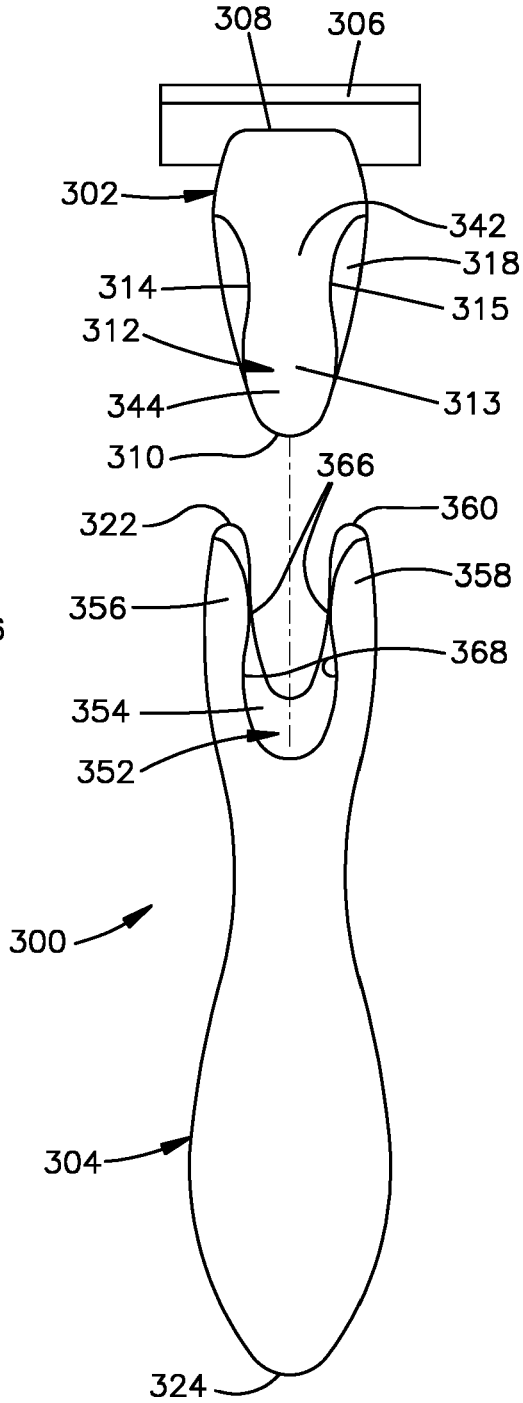
FIG. 3D is a diagram illustrating a top plan view of the shaving razor shown in FIG. 3B with the first handle detached from the second handle.

Turning to FIGS. 3A-3D, another embodiment of the present disclosure is illustrated with a shaving razor 300. Similar to the shaving razors 100, 200, the shaving razor 300 includes a body with two elongated components, i.e., an upper end component 302 and a lower end component 304, that are detachably secured together to provide a plurality of different use configurations as illustrated by FIGS. 3A, 3B. In this embodiment, an overall size of the upper end component 302 is smaller than that of the lower end component 304. The upper end component 302 is sized, shaped, and operable to function as a miniature or pocket-side handle to facilitate use of the shaving razor 300 when the upper end component 302 is detached from the lower end component 304. The lower end component 304 is sized, shaped, and operable to function as an extension handle to facilitate use of the shaving razor 300 when the upper end component 302 is attached to the lower end component 304. The upper end component 302 includes a shaver head 306 secured to an end 308 that is opposite to the lower end component 304. In this embodiment, the shaver head 306 is permanently secured to the upper end component 302 with a fixed orientation thereto, but it is foreseen that the shaver head 306 may be detachably secured to the upper end component 302 and/or pivotably secured to the upper end component 302 without deviating from the scope of the present disclosure. The shaver head 306 houses a plurality of blades and preferably includes at least one and up to ten blades. It is foreseen that the shaving head 306 may include a plurality of additional components, e.g., a guard bar and a cap, on either side of the plurality of blades, a lubrication strip, and/or a plurality of fins without deviating from the scope of the present disclosure.

Opposite to the end 308 of the upper end component 302 is a dome-shaped end 310 that forms a portion of a first grip 312. As will be apparent to one of skill in the art, it is foreseen that the upper-end component 302 may be otherwise shaped and yet have the same or similar functionality as discussed herein without deviating from the scope of the present disclosure. The grip 312 is defined by exterior surfaces of a plurality of intersecting features with different contours that collaboratively allow a user of the shaving razor 300 to securely grip and handle or manipulate the shaving razor 300 when the shaving razor 300 is in another use configuration as illustrated by FIG. 3B. The grip 312 includes a raised portion 313 with shoulders 314, 315 on sides thereof. Each of the shoulders 314, 315 is contoured and extends along the upper end component 302 from the shaver head 306 and the end 308, and to the dome-shaped end 310 of the upper end component 302. The raised portion 313 defines a ledge 316, which extends entirely around the upper end component 302 and between the shoulders 314, 315. The ledge 316 also forms part of the grip 312. Between the shoulders 314, 315 is a depressed connecting surface 318 that also forms part of the grip 312 and part of the dome-shaped end 310. The surface 318 partially extends along a length of the upper end component 302 and between the ends 308, 310.

The lower end component 304 includes a second grip 320. Similar to the grip 312 of the upper end component 302, the grip 320 is defined by exterior surfaces of a plurality of intersecting features with different contours that collaboratively allow the user of the shaving razor 300 to securely grip and handle, or manipulate, the shaving razor 300 when the shaving razor 300 is in the use configuration as illustrated by FIG. 3A. The grip 320 extends along an entire length of the lower end component 304 and between ends 322, 324 of the lower end component 304.

A connection means or connector 340 is formed on a portion of each of the upper end component 302 and the lower end component 304. On the upper end component 302, the connection means includes a first connecting portion comprising the shoulders 314, 315 which are contoured inwardly to form a narrow portion 342 with the shoulders 314, 315 extending toward each other, and a wide portion 344 with the shoulders 314, 315 extending away from each other, relative to the narrow portion 342. On the lower end component 304, the connector 340 or connection means includes a second connecting portion comprising a receiver 352 at the end 322 of the lower end component 304. The receiver 352 includes a cavity 354 that partially extends into the lower end component 304 and between opposing walls 356, 358 on either side of the cavity 354. The receiver 352 includes a ledge 360, which extends partially around the lower end component 304, between the walls 356, 358, and defines an outermost surface of the end 322 of the lower end component 304. Each of the walls 356, 358 are contoured and include a narrow portion 366 with the walls 356, 358 extending toward each other, and a wide portion 368 with the walls 356, 358 extending away from each other, relative to the narrow portion 366.

When the shaving razor 300 is in the use configuration as illustrated by FIG. 3A, an entirety of the interior portion of each of the wall 356, 358 continuously abuts the dome-shaped end 310. Further, when the shaving razor 300 is in the use configuration as illustrated by FIG. 1A, the ledge 316 of the upper end component 302 abuts the entirety of the ledge 360 of the lower end component 304. In other words, the external surface of the upper end component or pocket-size handle 302 is continued by the external surface of the lower end component or extension handle 304. In this manner, each of the ledges 316, 360 and the surface 318 are entirely concealed when the shaving razor 300 is in the use configuration as illustrated by FIG. 3A.

The walls 356, 358 are formed of a resilient material, e.g., rubber, which allows each of the walls 356, 358 to independently bend, e.g., toward or away from each other, upon application of a force by the user and return to an original configuration upon removal of the force. The resilient nature of the walls 356, 358 facilitates conversion of the shaving razor 300 to and from the configurations illustrated in FIGS. 3A, 3B. For instance, during attachment of the upper end component 302 to the lower end component 304, the components 302, 304 are aligned in a parallel direction so that the dome-shaped end 310 operates as a male portion and is partially extending between the walls 356, 358 and into the receiver 352, which operates as a female portion. The wide portion 344 of the upper end component 302 abuts the narrow portion 366 of the ledge 360, which prevents the dome-shaped end 310 from extending further into the receiver 352. Upon application of a force by the user, e.g., a force applied on one of the components 302, 304 to bias the one of the components 302, 304 toward another one of the components 302, 304, one or both of the walls 356, 358 are caused to bend away from the other one of the walls 356, 358, thereby allowing the wide portion 344 of the upper end component 302 to pass, which allows the dome-shaped end 310 to extend further into the receiver 352. The shaving razor 300 is designed such that the dome-shaped end 310 extends into the receiver 352 until: (1) the dome-shaped end 310 abuts an end of the receiver 352; (2) the ledges 316, 360 abut each other; (3) the wide portion 344 of the upper end component 302 is nested within the wide portion 368 of the lower end component 304; and (4) the narrow portion 342 of the upper end component 302 is nested within the narrow portion 366 of the lower end component 304, all of which generally occur simultaneously, thereby providing a resilient snap-fit engagement between the components 302, 304. The nesting of the portions 344, 368 and the portions 342, 366 independently, and collaboratively, prevent linear and/or rotational movement of the components 302, 304 relative to each other unless a force is applied on one or both of the components 302, 304. In this embodiment, the forces required to attach and detach the components 302, 304 are equal to each other.

To detach the components 302, 304 from each other, the force is applied, e.g., on one of the components 302, 304 to bias the one of the components 302, 304 away from another one of the components 302, 304. The force causes one or both of the walls 356, 358 to bend away from the other one of the walls 356, 358, thereby allowing the wide portion 344 of the upper end component 302 to pass by the narrow portion 366 of the ledge 360 so that the dome-shaped end 310 can be withdrawn from the receiver 352. It is foreseen that one or more components of the connector 340 could be formed of magnetic material to facilitate secure attachment of the connector 340 without deviating from the scope of the present disclosure. For instance, the surface 318 could be formed of a magnetic material and/or have a magnet embedded therein and the receiver 352 could be formed of another magnetic material and/or have another magnet embedded therein such that, when the components 302, 304 are joined together, a magnetic bond is formed thereby providing a secure connection therebetween.

Similar to the shaving razors 100, 200, when the shaving razor 300 is in the configuration illustrated in FIG. 3A, the grip 320 can be utilized by the user to guide the shaving head 306 across a surface, e.g., skin, of the user, thereby allowing the plurality of blades 309 to contact and sever hair on the surface of the user. Alternatively, the user may reconfigure the shaving razor 300 to the configuration illustrated in FIG. 3B by removing the lower end component 304 from the upper end component 302, as previously discussed, and utilize the grip 312 to guide the shaving head 306 across the surface of the user, thereby allowing the plurality of blades 309 to contact and sever hair on the surface of the user. In this configuration, the external surface of the upper end component or pocket-size handle 302 is not continued by the external surface of the lower end component or extension handle 304. The various configurations of the shaving razor 300 can be strategically utilized based on personal preferences of the user. For instance, the user might desire to utilize one or more of the various configurations of the shaving razor 300 to shave different body parts. Or, the user might desire to utilize one or more of the various configurations of the shaving razor 300 based on storage availability for storing the shaving razor 300, e.g., in a suitcase or travel bag.

Figures 4A, 4B, 4C, 4D, 4E:
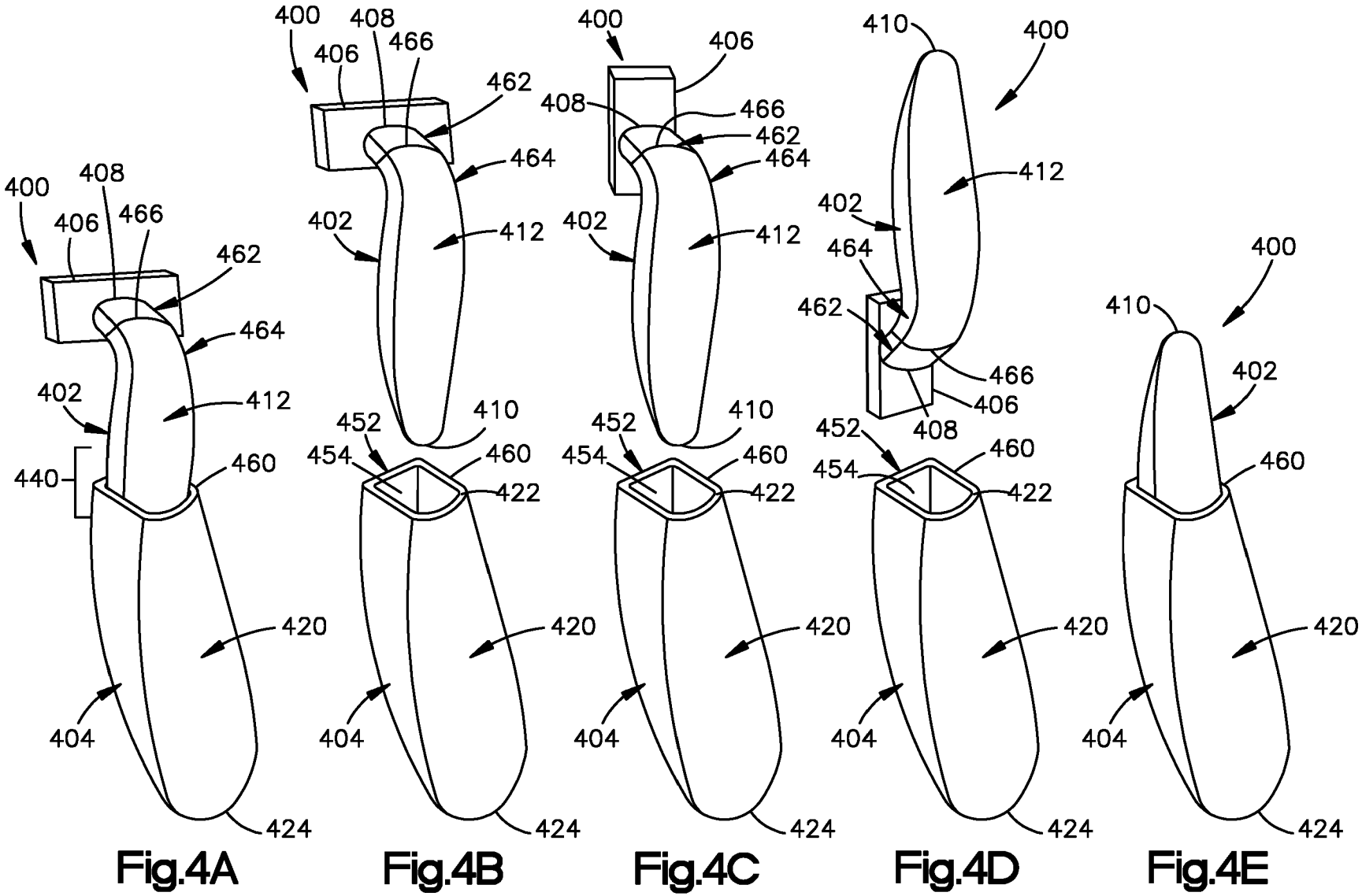
FIG. 4A is a diagram illustrating a perspective view of a shaving razor with a first handle detachably secured to a second handle.
FIG. 4B is a diagram illustrating a perspective view of the shaving razor shown in FIG. 4A with the first handle detached from the second handle.
FIG. 4C is a diagram illustrating a perspective view of the shaving razor shown in FIG. 4A with the first handle detached from the second handle.
FIG. 4D is a diagram illustrating a perspective view of the shaving razor shown in FIG. 4A with the first handle detached from the second handle.
FIG. 4E is a diagram illustrating a perspective view of the shaving razor shown in FIG. 4A with the first handle detachably secured to the second handle.

Turning to FIGS. 4A-4I, another embodiment of the present disclosure is illustrated with a shaving razor 400. Similar to the shaving razors 100, 200, 300, the shaving razor 400 includes a body with two elongated components, i.e., an upper end component 402 and a lower end component 404, that are detachably secured together to provide a plurality of different use configurations as illustrated by FIGS. 4A, 4B. In this embodiment, an overall size of the upper end component 402 is smaller than that of the lower end component 404. The upper end component 402 is sized, shaped, and operable to function as a miniature or pocket-side handle to facilitate use of the shaving razor 400 when the upper end component 402 is detached from the lower end component 404. The lower end component 404 is sized, shaped, and operable to function as an extension handle to facilitate use of the shaving razor 400 when the upper end component 402 is attached to the lower end component 404. The upper end component 402 includes a shaver head 406 secured to an end 408 that is opposite to the lower end component 404. In this embodiment, the shaver head 406 is permanently secured to the upper end component 402, with a fixed orientation thereto, but it is foreseen that the shaver head 406 may be detachably secured to the upper end component 402 and/or pivotably secured to the upper end component 402 without deviating from the scope of the present disclosure. The shaver head 406 houses a plurality of blades and preferably includes at least one and up to ten blades. It is foreseen that the shaving head 406 may include a plurality of additional components, e.g., a guard bar and a cap, on either side of the plurality of blades, a lubrication strip, and/or a plurality of fins without deviating from the scope of the present disclosure.

Opposite to the end 408 of the upper end component 402 is an end 410. Between the ends 408, 410 is a first grip 412 that extends along an entire length of the upper end component 402. The grip 412 is defined by exterior surfaces of a plurality of intersecting features with different contours that collaboratively allow a user of the shaving razor 400 to securely grip and handle or manipulate the shaving razor 400 when the shaving razor 400 is in the use configuration as illustrated by FIG. 4B.

The lower end component 404 includes a second grip 420. Similar to the grip 412 of the upper end component 402, the grip 420 is defined by exterior surfaces of a plurality of intersecting features with different contours that collaboratively allow the user of the shaving razor 400 to securely grip and handle or manipulate the shaving razor 400, when the shaving razor 400 is in the use configuration as illustrated by FIG. 4A. The grip 420 extends along an entire length of the lower end component 404 and between ends 422, 424 of the lower end component 404.

A connector 440 is formed on a portion of each of the upper end component 402 and the lower end component 404. On the upper end component 402, the connector 440 includes a plurality of contoured surfaces that extend along the upper end component 402, from an approximate midpoint of the upper end component 402 and to the end 410 of the upper end component 402. On the lower end component 404, the connector 440 includes a receiver 452 at the end 422 of the lower end component 404. The receiver 452 includes a cavity 454 that partially extends into the lower end component 404. The cavity 454 includes a plurality of interior walls that are sized and shaped to correspond to the plurality of contoured surfaces of the upper end component 402. The receiver 452 includes a ledge 460, which extends entirely around the lower end component 404, and defines an outermost surface of the end 422 of the lower end component 404. When the shaving razor 400 is in the use configuration as illustrated by FIG. 4A, the plurality of contoured surfaces of the upper end component 402 are entirely nested within the cavity 454 so that an entirety of the plurality of interior walls of the cavity 454 continuously abut the plurality of contoured surfaces of the upper end component 402 and a substantial portion of the grip 420 of the upper end component 402.

Figure 4F:
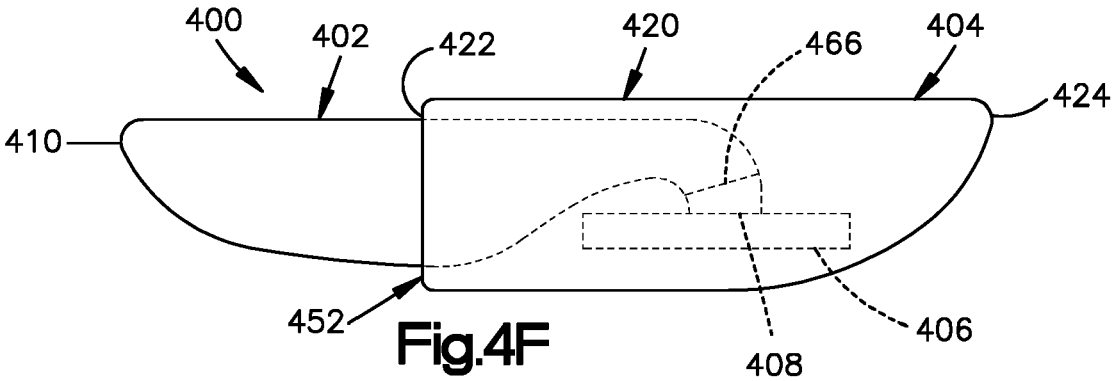
FIG. 4F is a diagram illustrating a magnified perspective view of the shaving razor shown in FIG. 4A with the first handle detachably secured to the second handle.
Figure 4G:
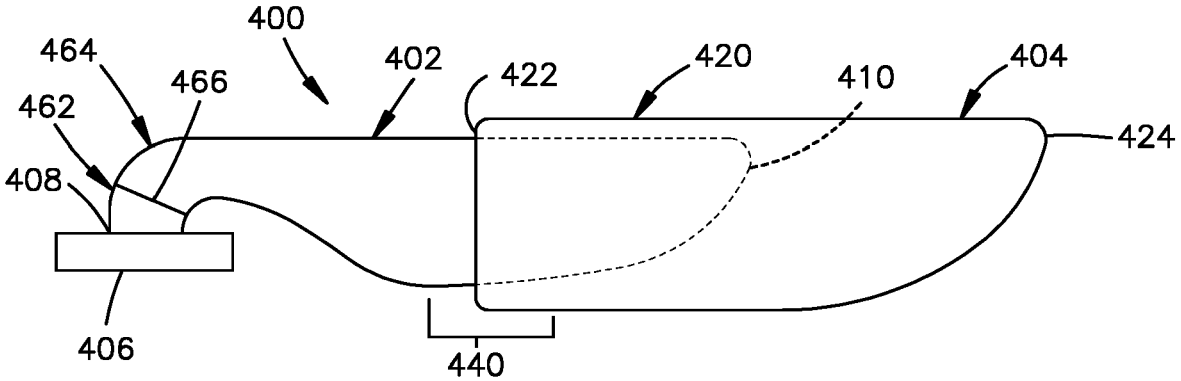
FIG. 4G is a diagram illustrating a magnified perspective view of the shaving razor shown in FIG. 4A with the first handle detachably secured to the second handle.
Figure 4H:
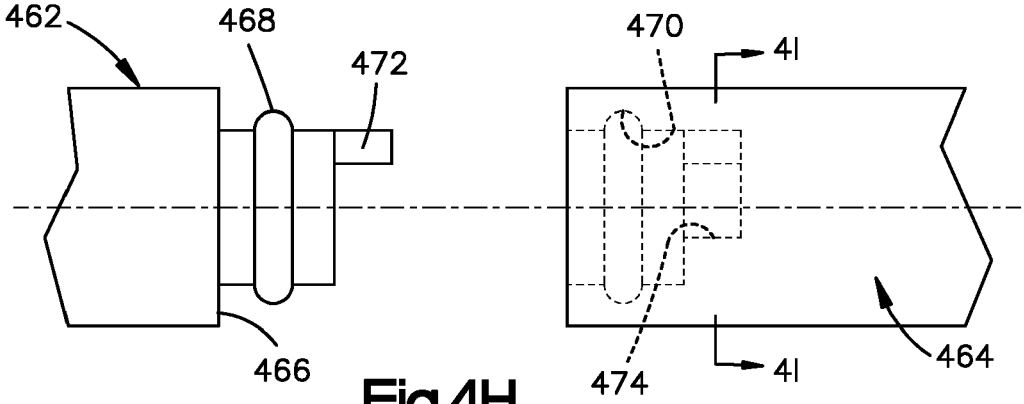
FIG. 4H is a diagram illustrating a magnified, elevated side plan view of the shaving razor shown in FIG. 4G with pivotable portions exploded along a pivot region.
Figure 4I:
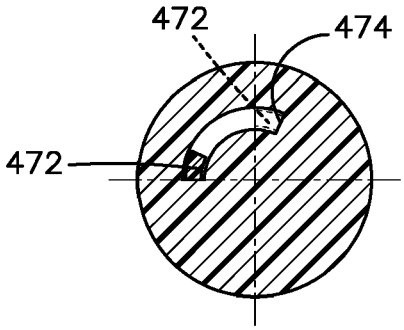
FIG. 4I is a diagram illustrating a cross-sectional elevated side view of the shaving razor shown in FIG. 4H along line 4I-4I.

The upper end component 402 houses a plurality of components that permit a pivotable portion 462 of the upper end component 402 to pivot along a pivot region 466 relative to another pivotable portion 464 of the upper end component 402. The portion 462 of the upper end component 402 includes a ring 468 that is sized and shaped to be received within a groove 470 in the portion 464 of the upper end component 402 upon assembly of the portions 462, 464. The ring 468 and the groove 470 are operable to allow rotational movement between the portions 462, 464 while preventing lateral movement between the portions 462, 464. A positioning protrusion 472 extends from the portion 462 and is slidably received within an arcuate slot 474 in the portion 464 upon assembly of the portions 462, 464. The protrusion 472 and the slot 474 are operable to define a range of pivot between the portions 462, 464, with maximum degrees of pivot illustrated by FIG. 4I. In this manner, the upper end component 402 is operable to permit the head 406 to pivot between a use configuration as illustrated by FIGS. 4A, 4G and a storage configuration as illustrated by FIGS. 4C, 4F. In the use configuration, the head 406 extends perpendicular to the upper end component 402. In the storage configuration, the head 406 extends parallel to the upper end component 402.

During attachment of the upper end component 402 to the lower end component 404 for the use configuration illustrated by FIG. 4A, the head 406 is pivoted to the use configuration and the components 402, 404 are aligned in a parallel direction so that the end 410 operates as a male portion and is partially extending into the receiver 452, which operates as a female portion. Upon application of a force by the user, e.g., a force applied on one of the components 402, 404 to bias the one of the components 402, 404 toward another one of the components 402, 404, the end 410 extends into the receiver 452. The shaving razor 400 is designed such that, the end 410 extends into the receiver 452 until the plurality of contoured surfaces of the upper end component 402 are entirely nested within the cavity 454 and abut the plurality of contoured surfaces of the upper end component 402. The corresponding contours of the components 402, 404 collaboratively prevent rotational movement of the components 402, 404 relative to each other unless a force is applied on one or both of the components 402, 404. To detach the components 402, 404 from each other, the force is applied, e.g., on one of the components 402, 404 to bias the one of the components 402, 404 away from another one of the components 402, 404. The force causes the end 410 to be withdrawn from the receiver 452. In this embodiment, the forces required to attach and detach the components 402, 404 are equal to each other.

During attachment of the upper end component 402 to the lower end component 404 for the storage configuration illustrated by FIG. 4E, the head 406 is pivoted to the storage configuration and the components 402, 404 are aligned in a parallel direction so that the end 408 operates as a male portion and is partially extending into the receiver 452, which operates as a female portion. Upon application of a force by the user, e.g., a force applied on one of the components 402, 404 to bias the one of the components 402, 404 toward another one of the components 402, 404, the end 408 extends into the receiver 452. The shaving razor 400 is designed such that, the end 408 extends into the receiver 452 until the plurality of contoured surfaces of the upper end component 402 are partially nested within the cavity 454 and abut the plurality of contoured surfaces of the upper end component 402. The corresponding contours of the components 402, 404 collaboratively prevent rotational movement of the components 402, 404 relative to each other unless a force is applied on one or both of the components 402, 404. To detach the components 402, 404 from each other, the force is applied, e.g., on one of the components 402, 404 to bias the one of the components 402, 404 away from another one of the components 402, 404. The force causes the end 408 to be withdrawn from the receiver 452. In this embodiment, the forces required to attach and detach the components 402, 404 are equal to each other.

Similar to the shaving razors 100, 200, 300, when the shaving razor 400 is in the configuration illustrated in FIG. 4A, the grip 420 can be utilized by the user to guide the shaving head 406 across a surface, e.g., skin, of the user, thereby allowing the plurality of blades to contact and sever hair on the surface of the user. Alternatively, the user may reconfigure the shaving razor 400 to the configuration illustrated in FIG. 4B by removing the lower end component 404 from the upper end component 402, as previously discussed, and utilize the grip 412 to guide the shaving head 406 across the surface of the user, thereby allowing the plurality of blades to contact and sever hair on the surface of the user. The various configurations of the shaving razor 400 can be strategically utilized based on personal preferences of the user. For instance, the user might desire to utilize one or more of the various configurations of the shaving razor 400 to shave different body parts. Or, the user might desire to utilize one or more of the various configurations of the shaving razor 400 based on storage availability for storing the shaving razor 400, e.g., in a suitcase or travel bag.

Figure 5A:
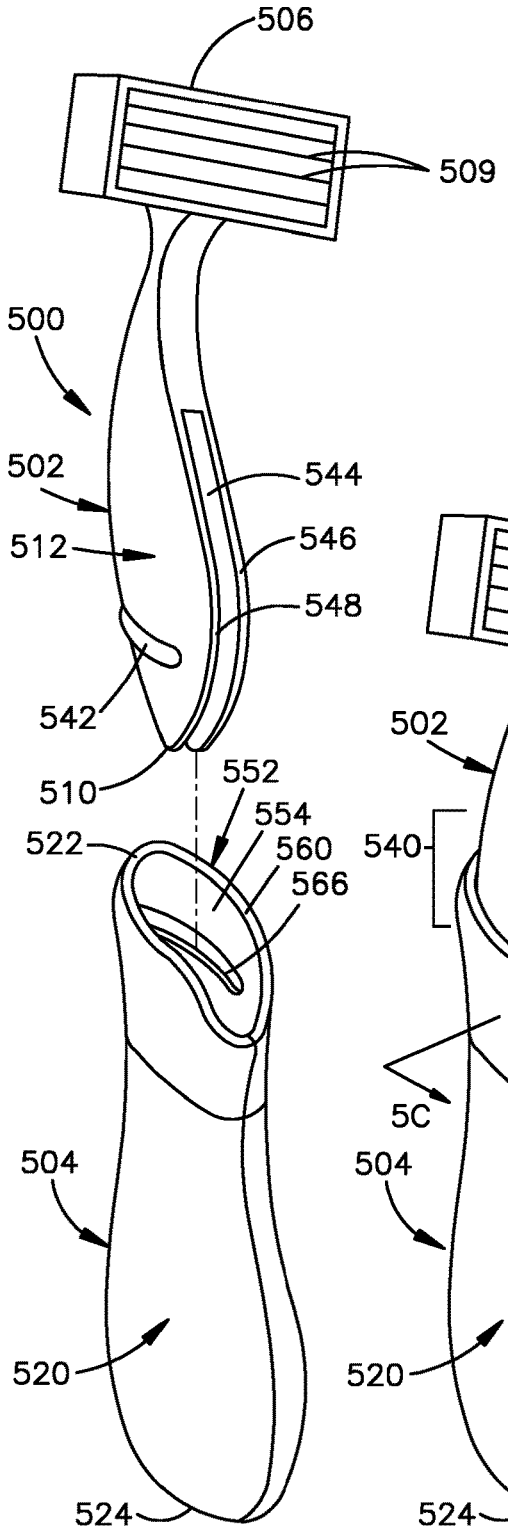
FIG. 5A is a diagram illustrating a perspective view of a shaving razor with a first handle detachably secured to a second handle.
Figure 5B:
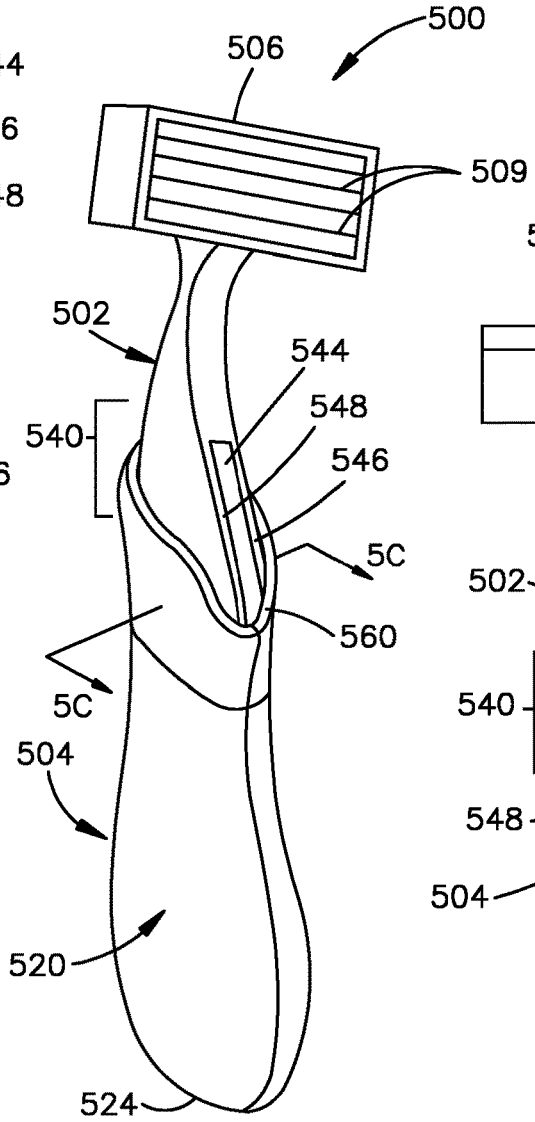
FIG. 5B is a diagram illustrating a perspective view of the shaving razor shown in FIG. 5A with the first handle detached from the second handle.
Figure 5C:
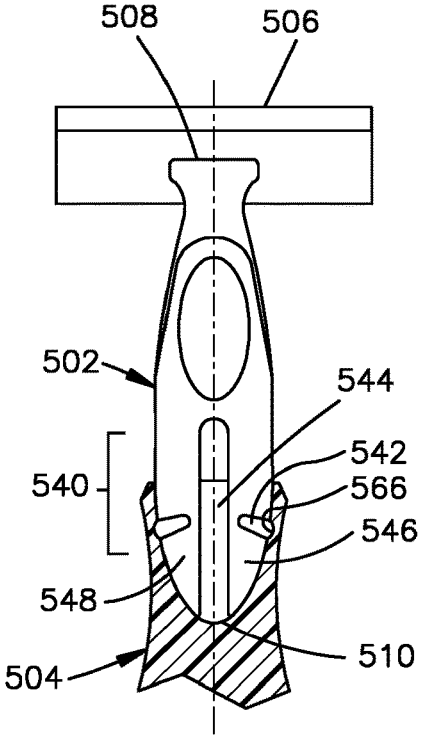
FIG. 5C is a diagram illustrating a magnified cross-sectional top plan view of the shaving razor shown in FIG. 5B along line 5C-5C with the first handle detachably secured to the second handle.

Turning to FIGS. 5A-5C, another embodiment of the present disclosure is illustrated with a shaving razor 500. Similar to the shaving razors 100, 200, 300, 400, the shaving razor 500 includes a body with two elongated components, i.e., an upper end component 502 and a lower end component 504, that are detachably secured together to provide a plurality of different use configurations as illustrated by FIGS. 5A, 5B. In this embodiment, an overall size of the upper end component 502 is smaller than that of the lower end component 504. The upper end component 502 is sized, shaped, and operable to function as a miniature or pocket-side handle to facilitate use of the shaving razor 500 when the upper end component 502 is detached from the lower end component 504. The lower end component 504 is sized, shaped, and operable to function as an extension handle to facilitate use of the shaving razor 500 when the upper end component 502 is attached to the lower end component 504. The upper end component 502 includes a shaver head 506 secured to an end 508 that is opposite to the lower end component 504. In this embodiment, the shaver head 506 is permanently secured to the upper end component 502 with a fixed orientation thereto, but it is foreseen that the shaver head 506 may be detachably secured to the upper end component 502 and/or pivotably secured to the upper end component 502 without deviating from the scope of the present disclosure. The shaver head 506 houses a plurality of blades 509 and preferably includes at least one and up to ten blades. It is foreseen that the shaving head 506 may include a plurality of additional components, e.g., a guard bar and a cap, on either side of the plurality of blades 509, a lubrication strip, and/or a plurality of fins without deviating from the scope of the present disclosure.

Opposite to the end 508 of the upper end component 502 is an end 510. Between the ends 508, 510 is a first grip 512 that extends along an entire length of the upper end component 502. The grip 512 is defined by exterior surfaces of a plurality of intersecting features with different contours that collaboratively allow a user of the shaving razor 500 to securely grip and handle or manipulate the shaving razor 500 when the shaving razor 500 is in the use configuration as illustrated by FIG. 5B.

The lower end component 504 includes a second grip 520. Similar to the grip 512 of the upper end component 502, the grip 520 is defined by exterior surfaces of a plurality of intersecting features with different contours that collaboratively allow the user of the shaving razor 500 to securely grip and handle, or manipulate, the shaving razor 500 when the shaving razor 500 is in the use configuration as illustrated by FIG. 5A. The grip 520 extends along an entire length of the lower end component 504 and between ends 522, 524 of the lower end component 504.

A connector 540 is formed on a portion of each of the upper end component 502 and the lower end component 504. On the upper end component 502, the connector 540 includes a rib 542 that extends partially around the upper end component 502. The connector 540 also includes a slot 544 that extends into the upper end component 502. The slot 544 extends along the upper end component 502, from an approximate midpoint of the upper end component 502 and to the end 510 of the upper end component 502. The slot 544 is defined by opposing walls 546, 548 on either side of the slot 544. On the lower end component 504, the connector 540 includes a receiver 552 at the end 522 of the lower end component 504. The receiver 552 includes a cavity 554 that partially extends into the lower end component 504. The receiver 552 includes a ledge 560, which extends entirely around the lower end component 504, and defines an outermost surface of the end 522 of the lower end component 504. The connector 540 includes a groove 566 that extend around an interior portion of the receiver 552. The groove 566 is sized and shaped to fully receive the rib 542. Thus, when the shaving razor 500 is in the use configuration as illustrated by FIG. 5A, the rib 542 is entirely nested within the groove 566 so that an entirety of the interior portion of the receiver 552 continuously abuts the end 510 and a substantial portion of the grip 512.

The walls 546, 548 of the upper end component 502 are formed of a resilient material, e.g., rubber or another resilient plastic, which allows each of the walls 546, 548 to independently bend, e.g., toward or away from each other, upon application of a force by the user and return to an original configuration upon removal of the force. The resilient nature of the walls 546, 548 facilitates conversion of the shaving razor 500 to and from the configurations illustrated in FIGS. 5A, 5B. For instance, during attachment of the upper end component 502 to the lower end component 504, the components 502, 504 are aligned in a parallel direction so that the end 510 operates as a male portion and is partially extending into the receiver 552, which operates as a female portion. The rib 542 abuts the ledge 560, which prevents the end 510 from extending further into the receiver 552. Upon application of a force by the user, e.g., a force applied on one of the components 502, 504 to bias the one of the components 502, 504 toward another one of the components 502, 504, one or both of the walls 546, 548 are caused to bend towards the other one of the walls 546, 548, thereby allowing the rib 542 of the upper end component 502 to pass, which allows the end 510 to extend further into the receiver 552. The shaving razor 500 is designed such that, the end 510 extends into the receiver 552 until: (1) the end 510 abuts an end of the receiver 552; and (2) the rib 542 of the upper end component 502 is nested within the groove 566 of the lower end component 504, which generally occur simultaneously, thereby providing a resilient snap-fit engagement between the components 502, 504. The nesting of the rib 542 within the groove 566 and corresponding contours of the components 502, 504 independently and collaboratively prevent linear and/or rotational movement of the components 502, 504 relative to each other unless a force is applied on one or both of the components 502, 504.

To detach the components 502, 504 from each other, the force is applied, e.g., on one of the components 502, 504 to bias the one of the components 502, 504 away from another one of the components 502, 504. The force causes one or both of the walls 546, 548 to bend toward the other one of the walls 546, 548, thereby allowing the rib 542 of the upper end component 502 to pass by the ledge 560 so that the end 510 can be withdrawn from the receiver 552. In this embodiment, the forces required to attach and detach the components 502, 504 are equal to each other.

Similar to the shaving razors 100, 200, 300, 400, when the shaving razor 500 is in the configuration illustrated in FIG. 5B, the grip 520 can be utilized by the user to guide the shaving head 506 across a surface, e.g., skin, of the user, thereby allowing the plurality of blades 509 to contact and sever hair on the surface of the user. Alternatively, the user may reconfigure the shaving razor 500 to the configuration illustrated in FIG. 5A by removing the lower end component 504 from the upper end component 502, as previously discussed, and utilize the grip 512 to guide the shaving head 506 across the surface of the user, thereby allowing the plurality of blades 509 to contact and sever hair on the surface of the user. The various configurations of the shaving razor 500 can be strategically utilized based on personal preferences of the user. For instance, the user might desire to utilize one or more of the various configurations of the shaving razor 500 to shave different body parts. Or, the user might desire to utilize one or more of the various configurations of the shaving razor 500 based on storage availability for storing the shaving razor 500, e.g., in a suitcase or travel bag.

Figure 6A:
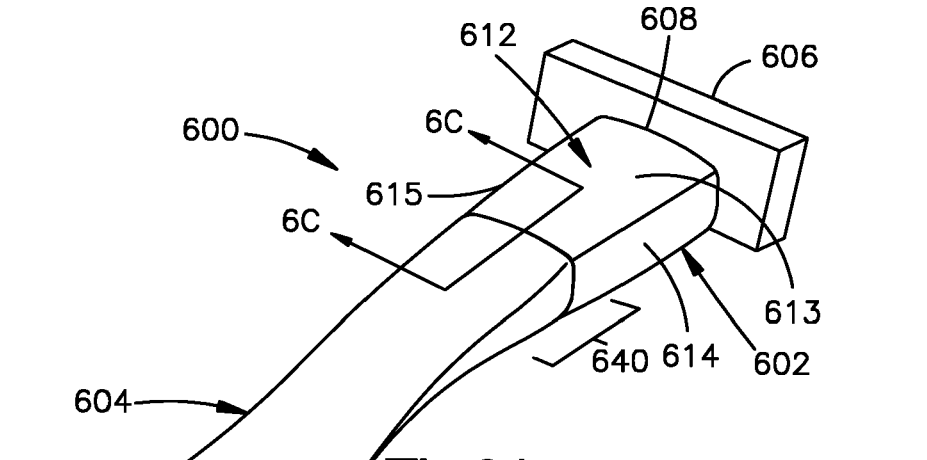
FIG. 6A is a diagram illustrating a perspective view of a shaving razor with a first handle detachably secured to a second handle.
Figure 6B:
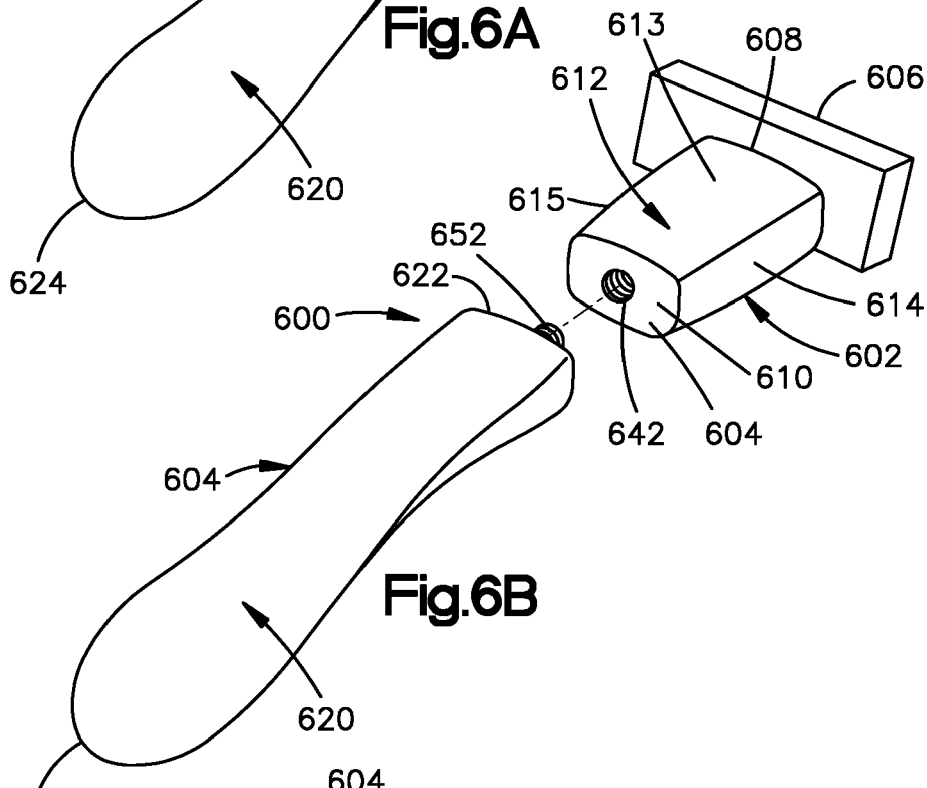
FIG. 6B is a diagram illustrating a perspective view of the shaving razor shown in FIG. 6A with the first handle detached from the second handle.
Figure 6C:
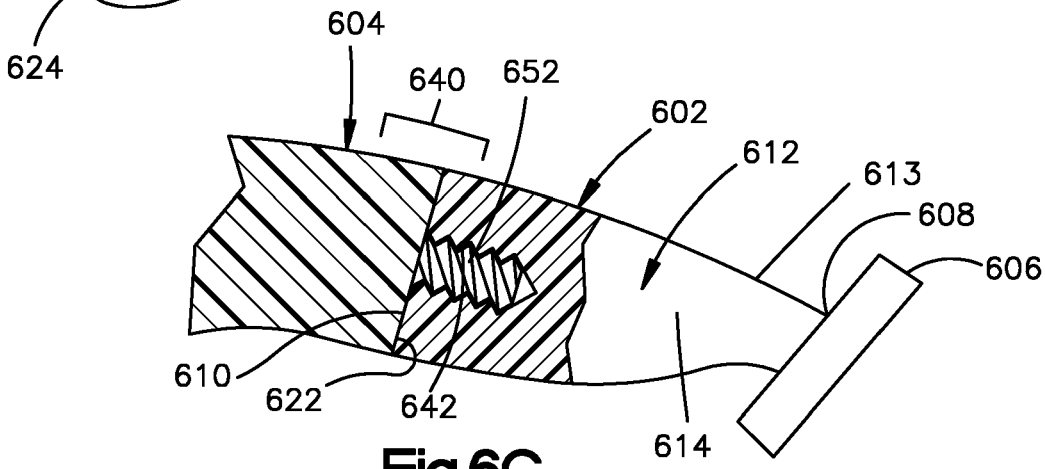
FIG. 6C is a diagram illustrating a magnified cross-sectional elevated side view of the shaving razor shown in FIG. 6A along line 6C-6C with the first handle detachably secured to the second handle.

Turning to FIGS. 6A-6C, another embodiment of the present disclosure is illustrated with a shaving razor 600. Similar to the shaving razors 100, 200, 300, 400, 500, the shaving razor 600 includes a body with two elongated components, i.e., an upper end component 602 and a lower end component 604, that are detachably secured together to provide a plurality of different use configurations as illustrated by FIGS. 6A, 6B. In this embodiment, an overall size of the upper end component 602 is smaller than that of the lower end component 604. The upper end component 602 is sized, shaped, and operable to function as a miniature or pocket-side handle to facilitate use of the shaving razor 600 when the upper end component 602 is detached from the lower end component 604. The lower end component 604 is sized, shaped, and operable to function as an extension handle to facilitate use of the shaving razor 600 when the upper end component 602 is attached to the lower end component 604. The upper end component 602 includes a shaver head 606 secured to an end 608 that is opposite to the lower end component 604. In this embodiment, the shaver head 606 is permanently secured to the upper end component 602, with a fixed orientation thereto, but it is foreseen that the shaver head 606 may be detachably secured to the upper end component 602 and/or pivotably secured to the upper end component 602 without deviating from the scope of the present disclosure. The shaver head 606 houses a plurality of blades and preferably includes at least one blade and/or up to ten blades. It is foreseen that the shaving head 606 may include a plurality of additional components, e.g., a guard bar and a cap, on either side of the plurality of blades, a lubrication strip, and/or a plurality of fins without deviating from the scope of the present disclosure.

Opposite to the end 608 of the upper end component 602 is a generally planar end 610 that forms a portion of a first grip 612. The grip 612 is defined by exterior surfaces of a plurality of intersecting features with different contours that collaboratively allow a user of the shaving razor 600 to securely grip and handle or manipulate the shaving razor 600, when the shaving razor 600 is in the use configuration as illustrated by FIG. 6B. The grip 612 includes a plurality of generally planar portions 613, 614, 615 on sides thereof. Each of the portions 613, 614, 615 extends along the upper end component 602, from the shaver head 606 and the end 610 to collaboratively define edges of the end 610.

The lower end component 604 includes a second grip 620. Similar to the grip 612 of the upper end component 602, the grip 620 is defined by exterior surfaces of a plurality of intersecting features with different contours that collaboratively allow the user of the shaving razor 600 to securely grip and handle or manipulate the shaving razor 600, when the shaving razor 600 is in the use configuration as illustrated by FIG. 6A. The grip 620 extends along an entire length of the lower end component 604 and between ends 622, 624 of the lower end component 604.

A connector 640 is formed on a portion of each of the upper end component 602 and the lower end component 604. On the upper end component 602, the connector 640 includes a circular aperture 642 that extend into the end 610. The aperture 642 is threaded and extends only partially into the upper end component 602. On the lower end component 604, the connector 640 includes a screw 652 extending from the end 622 of the lower end component 604. The screw 652 is threaded and is sized and shaped to be securely and rotatably received within the aperture 642 so that the end 622 of the lower end component 604 abuts an entirety of the end 610 of the upper end component 602. In this manner, the ends 610, 622 are entirely concealed when the shaving razor 600 is in the use configuration as illustrated by FIG. 6A. It is foreseen that the shaving razor 600 could be designed with the screw 652 and related components on the upper end component 602 and the aperture 642 and related components on the lower end component 604 without deviating from the scope of the present disclosure.

During attachment of the upper end component 602 to the lower end component 604, the components 602, 604 are aligned in a parallel direction so that the screw 652 partially extends into the aperture 642. Upon application of a rotational force, e.g., a force applied on one of the components 602, 604 to bias the one of the components 602, 604 toward another one of the components 602, 604, the threads of the screw 652 extend into the threads of the aperture 642 and the components 602, 604 are drawn closer to each other until the ends 610, 622 abut each other. The shaving razor 600 is designed such that, the screw 652 extends into the aperture 642 until: (1) the ends 610, 622 abut each other; and (2) the screw 652 abuts an interior wall of the aperture 642, which generally occur simultaneously. The threaded engagement of the screw 652 and the aperture 642 prevent lateral movement of the components 602, 604 relative to each.

To detach the components 602, 604 from each other, another rotational force in an opposite direction to the aforementioned rotational force is applied on one of the components 602, 604 to bias the one of the components 602, 604 away from another one of the components 602, 604, until the threads of the screw 652 are withdrawn from the threads of the aperture 642, which causes the components 602, 604 to be detached from each other.

Similar to the shaving razors 100, 200, 300, 400, 500, when the shaving razor 600 is in the configuration illustrated in FIG. 6A, the grip 620 can be utilized by the user to guide the shaving head 606 across a surface, e.g., skin, of the user, thereby allowing the plurality of blades to contact and sever hair on the surface of the user. Alternatively, the user may reconfigure the shaving razor 600 to the configuration illustrated in FIG. 6B by removing the lower end component 604 from the upper end component 602, as previously discussed, and utilize the grip 612 to guide the shaving head 606 across the surface of the user, thereby allowing the plurality of blades to contact and sever hair on the surface of the user. The various configurations of the shaving razor 600 can be strategically utilized based on personal preferences of the user. For instance, the user might desire to utilize one or more of the various configurations of the shaving razor 600 to shave different body parts. Or, the user might desire to utilize one or more of the various configurations of the shaving razor 600 based on storage availability for storing the shaving razor 600, e.g., in a suitcase or travel bag.

One of skill in the art will recognize that the described examples are not limited to any particular size. Further, one of skill in the art will recognize that the components of the shaving razors 100, 200, 300, 400, 500, 600 are not limited to any type of material. In a preferred example, the shaving razor, e.g., any one or more of the shaving razors 100, 200, 300, 400, 500, 600, is formed of one or more plastics and/or rubber, but may be formed of a variety of different materials including metal or the like, or a combination thereof. One skilled in the art will recognize that different diameters, types, and thicknesses of preferred materials can be utilized when taking into consideration design and stability considerations. A number of manufacturing techniques may be used such as the molding, machining, and/or casting one or more components of the shaving razor. An example process of manufacturing the shaving razors 100, 200, 300, 400, 500, 600 includes use of an injection molding process or other like manufacturing means.

The aforementioned disclosed first use configuration corresponds to a conventional shaving configuration. The conventional shaving configuration means the pocket-size handle is attached to the extension handle. Therefore the first connecting part is connected to the second connecting part. The overall dimension of the handle, comprising the pocket-size handle and the extension handle, along a longitudinal direction, is comprised between 10 cm and 20 cm. Furthermore, the aforementioned disclosed second use configuration corresponds to a non-conventional shaving configuration. The non-conventional shaving configuration means the pocket-size is detached from the extension handle. Thus, the extension handle is not used by a user in this non-conventional shaving configuration. The dimension of the pocket-size handle along a longitudinal direction is comprised between 2 cm and 7 cm.

It will be appreciated by those skilled in the art that changes could be made to the embodiments described herein without departing from the broad disclosure thereof. It is understood, therefore, that the present invention disclosed herein is not limited to the particular embodiments disclosed, and is intended to cover modifications within the spirit and scope of the present invention.

What is claimed is:

1. A shaving razor operable to be used in various configurations, the shaving razor comprising:

an upper end component including a shaver head and defining a first grip, the first grip operable to allow a user to securely grip and handle the shaver head;

a lower end component defining a second grip; and a connector including a first slot extending at least partially along a first interior wall of the lower end component and a first arm formed on the upper end component, wherein a buttress is formed at an end of the first arm, and wherein a depression is formed at an end of the first slot;

the connector being operable to allow the razor to be reconfigured between (i) a first use configuration having the upper end component detachably secured to the lower end component, with the first arm operable to nest within the first slot and the depression is shaped to receive the buttress, and (ii) a second use configuration having the upper end component detached from the lower end component such that the upper end component is operable to be independently used for shaving.

2. The shaving razor of claim 1, wherein, the upper end component and the lower end component are elongated, and the upper end component and the lower end component are aligned by the connector to extend in a parallel direction in the first use configuration.

3. The shaving razor of claim 1, wherein, the connector includes a male portion and a female portion, and the female portion defines a cavity operable to at least partially receive the male portion within the cavity.

4. The shaving razor of claim 3, wherein, the female portion partially surrounds the male portion in the first use configuration.

5. The shaving razor of claim 3, wherein, the male portion is included on the upper end component, and the female portion is included on the lower end component.

6. The shaving razor of claim 1, wherein, the connector includes a second slot extending at least partially along a second interior wall of the connector, and the connector includes a second arm operable to nest within the second slot in the first use configuration.

7. The shaving razor of claim 6, wherein, the second interior wall is opposite the first interior wall, and at least one of the first interior wall and the second interior wall is resilient and operable to expand away from each other when the razor is between the first configuration and the second configuration.

8. The shaving razor of claim 6, wherein, the second arm is opposite the first arm, and the first arm and the second arm are operable to prevent rotational movement of the upper end component relative to the lower end component in the first use configuration.

9. The shaving razor of claim 6, wherein, the buttress is operable to prevent linear movement of the upper end component relative to the lower end component in the first use configuration.

10. The shaving razor of claim 1, wherein, at least a portion of the connector is resilient, and the connector is operable to detachably secure the upper end component to the lower end component via a snap-fit engagement.

11. A reconfigurable shaving razor comprising:

a first component, a second component and a connector;

the first component including a shaver head, a first gripping portion, and a first portion of the connector including a first arm formed on the first component, wherein a buttress is formed at an end of the first arm, the first gripping portion operable to allow a user to securely grip and handle the shaver head such that the first component is operable to be independently used for shaving when detached from the second component; and the second component including a second gripping portion and a second portion of the connector including a slot extending at least partially along a first interior wall of the second component, wherein a depression is formed at an end of the slot;

Wherein the first arm is operable to nest within the slot and the depression is shaped to receive the buttress to allow detachably securing the first component to the second component and to allow the first component to assume various configurations relative to the second component.

12. The shaving razor of claim 11, wherein, the first component and the second component are elongated, and the first component and the second component are aligned by the connector to extend in a parallel direction in a first use configuration.

13. The shaving razor of claim 12, wherein, the second portion of the connector includes a second slot extending at least partially along a second interior wall of the second portion of the connector, and the first portion of the connector includes a second arm operable to nest within the second slot in the first use configuration.

14. The shaving razor of claim 13, wherein, at least one of the first interior wall and the second interior wall is resilient and operable to expand away from each other when the razor is between the first configuration and a second configuration.

15. The shaving razor of claim 13,
wherein,
the first arm and the second arm are operable to prevent rotational movement of the first component relative to the second component in the first use configuration.

16. The shaving razor of claim 13,
wherein,
the buttress is operable to prevent linear movement of the first component relative to the second component in the first use configuration.

17. The shaving razor of claim 11,
wherein,
the first portion of the connector includes a male portion and the second portion of the connector includes a female portion, and
the female portion defines a cavity operable to at least partially receive the male portion within the cavity in a first use configuration.

18. The shaving razor of claim 17,
wherein,
the female portion partially surrounds the male portion in the first use configuration.

19. The shaving razor of claim 17,
wherein,
the male portion is included on the first component, and
the female portion is included on the second component.

20. The shaving razor of claim 11,
wherein,
at least a portion of the connector is resilient, and
the connector is operable to detachably secure the first component to the second component via a snap-fit engagement.

* * * * *